US012571553B2

(12) United States Patent
Douglas et al.

(10) Patent No.: US 12,571,553 B2
(45) Date of Patent: Mar. 10, 2026

(54) BUILDING AIR QUALITY ASSESSMENT

(71) Applicant: Tyco Fire & Security GmbH, Neuhausen am Rheinfall (CH)

(72) Inventors: Jonathan D. Douglas, Mequon, WI (US); Bernard P. Clement, Mequon, WI (US)

(73) Assignee: TYCO FIRE & SECURITY GMBH, Neuhausen am Rheinfall (CH)

( * ) Notice: Subject to any disclaimer, the term of this patent is extended or adjusted under 35 U.S.C. 154(b) by 309 days.

(21) Appl. No.: 18/229,079

(22) Filed: Aug. 1, 2023

(65) Prior Publication Data

US 2024/0044538 A1 Feb. 8, 2024

Related U.S. Application Data

(60) Provisional application No. 63/394,536, filed on Aug. 2, 2022.

(51) Int. Cl.
*F24F 11/52* (2018.01)
*F24F 11/64* (2018.01)
(Continued)

(52) U.S. Cl.
CPC ..... *F24F 11/52* (2018.01); *F24F 11/64* (2018.01); *F24F 2110/50* (2018.01); *F24F 2110/52* (2018.01); *F24F 2120/10* (2018.01)

(58) Field of Classification Search
CPC ..... F24F 11/52; F24F 11/64; F24F 2110/50; F24F 2110/52; F24F 2120/10; F24F 11/30; F24F 11/0001; F24F 11/46
See application file for complete search history.

(56) References Cited

U.S. PATENT DOCUMENTS

2003/0071814 A1 4/2003 Jou et al.
2004/0152408 A1* 8/2004 Eckhardt ..... B60H 1/00742 454/99
(Continued)

FOREIGN PATENT DOCUMENTS

GB 2 553 375 A 3/2016
KR 101591735 B1 * 2/2016 ..... G06Q 50/10
WO WO-03/042603 A1 5/2003

OTHER PUBLICATIONS

Johnson, D.L., Lynch, R.A., Floyd, E.L., Wang, J. and Bartels, J.N., 2018. Indoor air quality in classrooms: Environmental measures and effective ventilation rate modeling in urban elementary schools. Building and Environment, 136, pp. 185-197. (Year: 2018).*
(Continued)

*Primary Examiner* — Alicia M. Choi
(74) *Attorney, Agent, or Firm* — Foley & Lardner LLP

(57) ABSTRACT

Systems, methods, and computer-readable storage media for building air quality assessment. One system includes a one or more processors configured to receive air quality measurements of at least a plurality of air quality sensors of a plurality of spaces of the building. The one or more processors further configured to generate a plurality of air quality metrics of the plurality of spaces based on the air quality measurements and at least one IAQ performance metric, and wherein the at least one IAQ performance metric contextualizes the air quality measurements. The one or more processors further configured to generate a graphical interface including a plurality of interface objects corresponding to the plurality of air quality metrics of the plurality of spaces of the building and cause a display device of a user device to display the graphical interface.

20 Claims, 17 Drawing Sheets

(51) Int. Cl.

| | |
|---|---|
| *F24F 110/50* | (2018.01) |
| *F24F 110/52* | (2018.01) |
| *F24F 120/10* | (2018.01) |

(56) References Cited

U.S. PATENT DOCUMENTS

| | | | | |
|---|---|---|---|---|
| 2006/0173579 | A1 | 8/2006 | Desrochers et al. | |
| 2006/0212203 | A1 | 9/2006 | Furuno | |
| 2009/0150090 | A1 | 6/2009 | Brodsky | |
| 2015/0032264 | A1 | 1/2015 | Emmons et al. | |
| 2015/0058062 | A1 | 2/2015 | Mejegard et al. | |
| 2016/0327921 | A1 | 11/2016 | Ribbich et al. | |
| 2017/0176030 | A1* | 6/2017 | Emmons | F24F 11/62 |
| 2018/0318746 | A1* | 11/2018 | Thomas | F24F 11/39 |
| 2018/0335770 | A1 | 11/2018 | Uemura | |
| 2018/0375444 | A1 | 12/2018 | Gamroth | |
| 2019/0033278 | A1 | 1/2019 | Mou et al. | |
| 2019/0034066 | A1 | 1/2019 | Nayak et al. | |
| 2020/0224915 | A1 | 7/2020 | Nourbakhsh et al. | |
| 2021/0003308 | A1 | 1/2021 | Venne | |
| 2021/0010701 | A1 | 1/2021 | Nesler et al. | |
| 2021/0011444 | A1 | 1/2021 | Risbeck et al. | |
| 2021/0018210 | A1 | 1/2021 | Nasis | |
| 2021/0060473 | A1 | 3/2021 | Caesar et al. | |
| 2021/0071894 | A1 | 3/2021 | Nigg et al. | |
| 2021/0172636 | A1 | 6/2021 | Jones et al. | |
| 2021/0381709 | A1 | 12/2021 | Liu | |
| 2021/0398230 | A1 | 12/2021 | Gupta et al. | |
| 2022/0035326 | A1 | 2/2022 | Peters et al. | |
| 2022/0058545 | A1 | 2/2022 | Warake et al. | |
| 2022/0058556 | A1 | 2/2022 | Warake et al. | |
| 2022/0137580 | A1 | 5/2022 | Burroughs et al. | |
| 2022/0154956 | A1 | 5/2022 | Maruyama et al. | |
| 2022/0188716 | A1 | 6/2022 | Mathieu et al. | |
| 2022/0203287 | A1 | 6/2022 | Wenger et al. | |
| 2022/0203288 | A1 | 6/2022 | Wenger et al. | |
| 2022/0205962 | A1 | 6/2022 | Vanderkoy | |
| 2022/0207215 | A1 | 6/2022 | Liu et al. | |
| 2022/0221184 | A1 | 7/2022 | Gupta et al. | |
| 2022/0228756 | A1 | 7/2022 | Gupta et al. | |
| 2022/0254483 | A1 | 8/2022 | Boisvert et al. | |
| 2022/0265224 | A1 | 8/2022 | Hauptman et al. | |
| 2022/0277851 | A1 | 9/2022 | Wellig | |
| 2022/0282886 | A1 | 9/2022 | Hriljac et al. | |
| 2022/0293261 | A1 | 9/2022 | Mcbrady et al. | |
| 2022/0305438 | A1 | 9/2022 | Wenger et al. | |
| 2022/0305881 | A1 | 9/2022 | Neu et al. | |
| 2022/0404056 | A1* | 12/2022 | Bloemer | F24F 11/58 |
| 2023/0228444 | A1 | 7/2023 | Xiong et al. | |
| 2023/0280058 | A1* | 9/2023 | He | F24F 11/30 700/276 |
| 2023/0324355 | A1* | 10/2023 | Nallaperumal | F24F 11/63 702/32 |
| 2023/0366581 | A1 | 11/2023 | Hingorani et al. | |
| 2024/0003576 | A1* | 1/2024 | Pal | F24F 11/65 |
| 2024/0127960 | A1 | 4/2024 | Palanivel et al. | |

OTHER PUBLICATIONS

Alvarado et al., "A Methodology to Monitor Airborne PM10 Dust Particles Using a Small Unmanned Aerial Vehicle," Sensors, 2017, vol. 17 (25 pages).

Ashrae, "Standards 62.1 and 62.2: The Standards for Ventilation and Indoor Air quality," URL: https://www.ashrae.org/technical-resources/bookstore/standards-62-1-62-2, retrieved from internet Aug. 9, 2022 (7 pages).

Safetraces, "Verifying Cost Efficient Indoor Air Quality," URL: https://www.safetraces.com/how-it-works, retrieved from internet Aug. 9, 2022 (6 pages).

UL Solutions, "Services for healthy buildings: UL Verified Ventilation and Filtration," URL: https://collateral-library-production.s3.amazonaws.com/uploads/asset_file/attachment/40264/Verified_Ventilation_and_Filtration_Flyer_FINAL.pdf, retrieved from internet Aug. 9, 2022 (1 page).

UL Solutions, "Verified Healthy Building: Demonstrate the health of your buildings with a UL Verified Healthy Building Mark." URL: https://www.ul.com/services/verified-healthy-buildings, retrieved from the internet Aug. 9, 2022 (13 pages).

75F, "75F IAQ Sense Kit," 75F, URL: https://f.hubspotusercontent10.net/hubfs/2679969/IAQSenseKit%20(1).pdf, retrieved from internet Mar. 14, 2025 (2 pages).

* cited by examiner

1500

| # | SCHOOL | COUNTY | APPARENT AGE OF SCHOOL (YEARS) |
|---|---|---|---|
| 01 | SCHOOL A | DALLAS | UNDER 10YRS |
| 12 | SCHOOL B | TERRENT | UNDER 10YRS |
| 09 | SCHOOL C | COLLIN | UNDER 10YRS |
| 06 | SCHOOL D | DENTON | UNDER 5YRS |
| 15 | SCHOOL E | TERRENT | UNDER 10YRS |
| 16 | SCHOOL F | DALLAS | UNDER 10YRS |
| 18 | SCHOOL G | COLLIN | OVER 10YRS |
| 10 | SCHOOL H | DENTON | UNDER 10YRS |
| 20 | SCHOOL I | TERRENT | OVER 20YRS |
| 25 | SCHOOL J | DALLAS | UNDER 10YRS |
| 26 | SCHOOL K | COLLIN | OVER 10YRS |
| 02 | SCHOOL L | DENTON | UNDER 10YRS |

FIG. 15

| TEMPERATURE | RH | FILTRATION | VENTILATION |
|---|---|---|---|
| 5 | 5 | 5 | 5 |
| 5 | 4 | 5 | 5 |
| 5 | 5 | 2 | 5 |
| 5 | 4 | 2 | 5 |
| 4 | 5 | 2 | 5 |
| 5 | 1 | 5 | 4 |
| 4 | 4 | 3 | 4 |
| 4 | 3 | 4 | 3 |
| 2 | 5 | 2 | 5 |
| 5 | 1 | 4 | 4 |
| 4 | 5 | 3 | 2 |
| 4 | 4 | 1 | 4 |

BUILDING AIR QUALITY ASSESSMENT

This application claims the benefit of, and priority to, U.S. Provisional Application No. 63/394,536, filed Aug. 2, 2022, which is incorporated by reference herein in its entirety for all purposes.

BACKGROUND

The present disclosure relates generally to building analytical systems. The present disclosure relates more particularly to indoor air quality assessment for buildings. Building environmental conditions and occupancy levels can affect the health and safety of building occupants. It may be difficult to address potential issues affecting air quality without having an accurate set of data that depicts what the actual air quality is in various spaces and under various conditions in a building.

SUMMARY

Some embodiments relate to a building analytical system for a building, the building analytical system comprising one or more memory devices storing instructions thereon that, when executed by one or more processors, cause the one or more processors to receive air quality measurements of at least a plurality of air quality sensors of a plurality of spaces of the building over a duration during a monitoring period. The instructions further cause the one or more processors to generate a plurality of air quality metrics of the plurality of spaces based on the air quality measurements and at least one IAQ performance metric, wherein the at least one IAQ performance metric contextualizes the air quality measurements of the building over the duration during the monitoring period, and wherein the plurality of air quality metrics correspond to a plurality of ranges of air quality values. The instructions further cause the one or more processors to generate a graphical interface comprising a plurality of interface objects corresponding to the plurality of air quality metrics of the plurality of spaces of the building, wherein the plurality of interface objects correspond to at least one of an indoor air quality improvement or an energy savings opportunity. The instructions further cause the one or more processors to cause a display device of a user device to display the graphical interface.

In some embodiments, the generation of the plurality of air quality metrics comprises comparing the air quality measurements with the at least one IAQ performance metric, and wherein the at least one IAQ performance metric comprises at least one of an estimated occupancy, a building system schedule, a building operating condition, or temporal representations of levels of air quality.

In some embodiments, the plurality of interface objects of the graphical interface comprise a detected occupied period based on the indication of occupancy or the estimated occupancy of the at least one IAQ performance metric over the duration, a current schedule based on the building system schedule of the at least one IAQ performance metric over the duration, a recommended schedule based on analyzing the plurality of air quality metrics over the duration and determining an improvement of the current schedule to increase air quality of the building, raw air quality data based on the air quality measurements.

In some embodiments, the graphical interface comprises a plurality of graphical areas, and wherein at least one of the plurality of graphical areas comprises a ventilation-occupancy data point, and wherein a first object of the plurality of interface objects is the ventilation-occupancy data point corresponding to a recommended ventilation action based on the estimated occupancy and at least one of the building system schedule or the building operating condition, and wherein the first object corresponds to a space of the plurality of spaces of the building.

In some embodiments, the graphical interface is a scatter plot graph, and wherein a first object of the plurality of interface objects is an outlier data point in the scatter plot graph, and wherein the first object corresponds to a space of the plurality of spaces of the building.

In some embodiments, at least one of the plurality of interface objects corresponds to an indication of a range of air quality values of the plurality of ranges of air quality values, and wherein the plurality of ranges of air quality values comprise a low value, a low-medium value, a medium value, a medium-high value, and a high value.

In some embodiments, the graphical interface is a graph comprising at least one plotted air quality variable, and wherein the at least one plotted air quality variable is overlayed on a plurality of graphics corresponding to at least one of the plurality of ranges of air quality values, and wherein the at least one plotted air quality variable comprises an indication of occupation, and wherein the at least one plotted air quality variable is a first object of the plurality of interface objects and the plurality of graphics is a second object of the plurality of interface objects.

In some embodiments, the plurality of air quality metrics comprises at least one building air quality metric of the building, and wherein the graphical interface is a chart comparing a plurality of building air quality metrics including the at least one building air quality metric across a plurality of buildings, and wherein the plurality of building air quality metrics corresponds to at least one of the plurality of ranges of air quality values.

In some embodiments, the plurality of air quality metrics comprises at least one building air quality metric of the building, and wherein the graphical interface is a geographic map comparing a plurality of building air quality metrics including the at least one building air quality metric across a plurality of buildings, and wherein the plurality of building air quality metrics corresponds to at least one of the plurality of ranges of air quality values, and wherein a first geographic location of the building is a first object of the plurality of interface objects and a second geographic location of another building is a second object of the plurality of interface objects.

In some embodiments, the graphical interface comprises a first estimated savings plan for the plurality of spaces of the building based on a first building operating condition, and wherein the graphical interface comprises a second estimated savings plan for the plurality of spaces of the building based on a second building operating condition, and wherein the first estimated savings plan is a first object of the plurality of interface objects and the second estimated savings plan is a second object of the plurality of interface objects.

In some embodiments, the air quality measurements are at least one of total volatile organic compounds (TVOC), carbon dioxide (CO2), carbon monoxide (CO), nitrogen dioxide (NO2), sulfur dioxide (SO2), ozone, particulate matters, formaldehyde, fungi, lead (Pb), bacteria, protist, virus, or pathogen.

In some embodiments, the instructions cause the one or more processors to receive indoor air quality measurements of the plurality of air quality sensors of the plurality of spaces of the building, receive outdoor air quality measurements of outdoor air quality outside the building, wherein the generation of the plurality of air quality metrics of the plurality of spaces further comprises comparing the indoor air quality measurements to the outdoor air quality measurements, and wherein the plurality of air quality metrics are a ratio of the indoor air quality measurements to the outdoor air quality measurements.

In some embodiments, the plurality of air quality sensors are a plurality of temporary air quality sensors installed throughout the plurality of spaces of the building for a period of time, wherein the instructions cause the one or more processors to connect to the plurality of temporary air quality sensors installed throughout the plurality of spaces of the building for the period of time, and disconnect from the plurality of temporary air quality sensors at an end of the period of time, wherein the plurality of temporary air quality sensors are uninstalled at the end of the period of time.

In some embodiments, the building analytical system is a cloud system located remotely from the building, and wherein the cloud system is configured to receive the air quality measurements via one or more wireless networks of the building, and wherein the plurality of temporary air quality sensors are configured to wirelessly communicate via the one or more wireless networks.

In some embodiments, the instructions cause the one or more processors to generate a control strategy, based on the plurality of air quality metrics and a viral index, the control strategy for controlling equipment of the building to reduce a spread of an infectious disease among occupants of the building, cause a building management system to implement the control strategy to control the equipment of the building to reduce the spread of the infectious disease among the occupants of the building.

Some embodiments relate to a method, including receiving, by one or more processing circuits, air quality measurements of at least a plurality of air quality sensors of a plurality of spaces of the building over a duration during a monitoring period. The method further includes generating, by the one or more processing circuits, a plurality of air quality metrics of the plurality of spaces based on the air quality measurements and at least one IAQ performance metric, wherein the at least one IAQ performance metric contextualizes the air quality measurements of the building over the duration during the monitoring period, and wherein the plurality of air quality metrics correspond to a plurality of ranges of air quality. The method further includes generating, by the one or more processing circuits, a graphical interface comprising a plurality of interface objects corresponding to the plurality of air quality metrics of the plurality of spaces of the building, wherein the plurality of interface objects correspond to at least one of an indoor air quality improvement or an energy savings opportunity. The method further includes causing, by the one or more processing circuits, a display device of a user device to display the graphical interface.

In some embodiments, the generation of the plurality of air quality metrics comprises comparing the air quality measurements with the at least one IAQ performance metric, and wherein the at least one IAQ performance metric comprises at least one of an estimated occupancy, a building system schedule, a building operating condition, or temporal representations of levels of air quality.

In some embodiments, at least one of the plurality of interface objects corresponds to an indication of a range of air quality values of the plurality of ranges of air quality values, and wherein the plurality of ranges of air quality values comprise a low value, a low-medium value, a medium value, a medium-high value, and a high value.

Some embodiments relate to one or more non-transitory computer readable mediums storing instructions thereon that, when executed by one or more processors, cause the one or more processors to receive air quality measurements of at least a plurality of air quality sensors of a plurality of spaces of the building over a duration during a monitoring period, generate a plurality of air quality metrics of the plurality of spaces based on the air quality measurements and at least one IAQ performance metric, wherein the at least one IAQ performance metric contextualizes the air quality measurements of the building over the duration during the monitoring period, and wherein the plurality of air quality metrics correspond to a plurality of ranges of air quality, generate a graphical interface comprising a plurality of interface objects corresponding to the plurality of air quality metrics of the plurality of spaces of the building, wherein the plurality of interface objects correspond to at least one of an indoor air quality improvement or an energy savings opportunity, and cause a display device of a user device to display the graphical interface.

In some embodiments, the generation of the plurality of air quality metrics comprises comparing the air quality measurements with the at least one IAQ performance metric, and wherein the at least one IAQ performance metric comprises at least one of an estimated occupancy, a building system schedule, a building operating condition, or temporal representations of levels of air quality, and wherein at least one of the plurality of interface objects corresponds to an indication of a range of air quality values of the plurality of ranges of air quality values, and wherein the plurality of ranges of air quality values comprise a low value, a low-medium value, a medium value, a medium-high value, and a high value.

BRIEF DESCRIPTION OF THE DRAWINGS

Various objects, aspects, features, and advantages of the disclosure will become more apparent and better understood by referring to the detailed description taken in conjunction with the accompanying drawings, in which like reference characters identify corresponding elements throughout. In the drawings, like reference numbers generally indicate identical, functionally similar, and/or structurally similar elements.

It will be recognized that some or all of the figures are schematic representations for purposes of illustration. The figures are provided for the purpose of illustrating one or more embodiments with the explicit understanding that they will not be used to limit the scope or the meaning of the claims.

DETAILED DESCRIPTION

Referring generally to the Figures, systems and methods are provided by monitoring air quality in a building with multiple spaces. According to various example embodiments, sensors may be deployed into multiple spaces and used over a period of time to collect data regarding the air quality in the spaces. In some embodiments, the sensors may be deployed temporarily (e.g., as a service) and removed at the end of the monitoring/test period. In other embodiments, the sensors may be permanently installed. By monitoring air quality in a building/facility for period of time, analyses are compiled. An indoor air quality analyst or a building management system may review the analyses and provide recommendations on actions that may be taken to improve the indoor air quality of a building/facility. The collected data may be used to generate insights as to the air quality of the spaces and actions that may be taken to improve the air quality or help protect the health of the occupants. While certain examples of the present disclosure discuss assessment of air quality for buildings, it should be noted that the features of the present disclosure are equally applicable to any type of building or group of buildings having multiple spaces into which sensors may be temporarily or permanently installed, including, for example, businesses such as retail buildings, office buildings, college/university campuses, or any other type of building or set of buildings.

Building Management System and HVAC System

Figure 1:
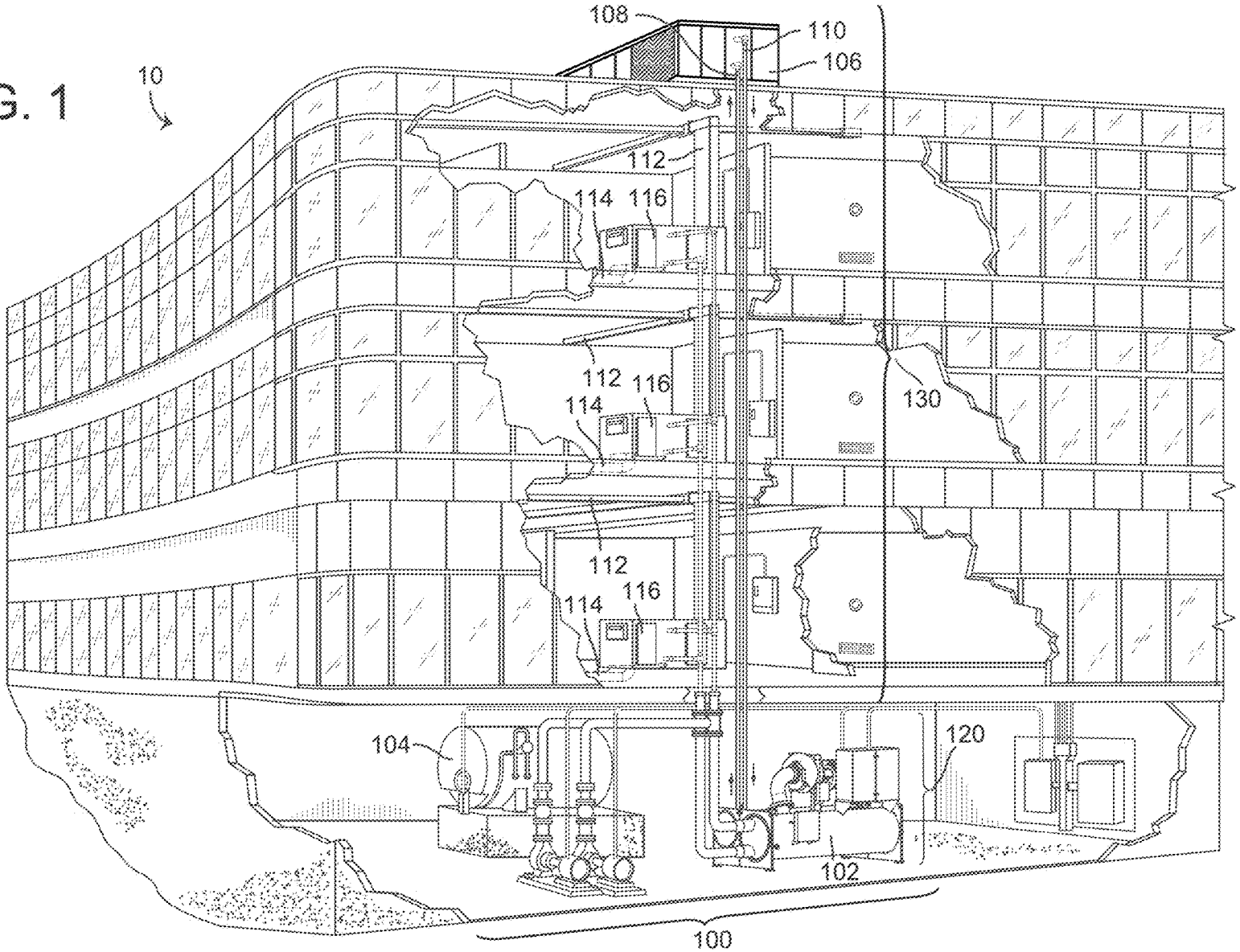
FIG. 1 is a drawing of a building equipped with a HVAC system, according to an exemplary embodiment.

Referring now to FIG. 1, an exemplary building management system (BMS) and HVAC system in which the systems and methods of the present invention can be implemented are shown, according to an exemplary embodiment. Referring particularly to FIG. 1, a perspective view of a building 10 is shown. Building 10 is served by a BMS. A BMS is, in general, a system of devices configured to control, monitor, and manage equipment in or around a building or building area. A BMS can include, for example, a HVAC system, a security system, a lighting system, a fire alerting system, and/or any other system that is capable of managing building functions or devices, or any combination thereof.

The BMS that serves building 10 includes an HVAC system 100. HVAC system 100 can include HVAC devices (e.g., heaters, chillers, air handling units, pumps, fans, thermal energy storage, etc.) configured to provide heating, cooling, ventilation, or other services for building 10. For example, HVAC system 100 is shown to include a waterside system 120 and an airside system 130. Waterside system 120 can provide a heated or chilled fluid to an air handling unit of airside system 130. Airside system 130 can use the heated or chilled fluid to heat or cool an airflow provided to building 10. An exemplary waterside system and airside system which can be used in HVAC system 100 are described in greater detail with reference to FIGS. 2-3.

HVAC system 100 is shown to include a chiller 102, a boiler 104, and a rooftop air handling unit (AHU) 106. Waterside system 120 can use boiler 104 and chiller 102 to heat or cool a working fluid (e.g., water, glycol, etc.) and can circulate the working fluid to AHU 106. In various embodiments, the HVAC devices of waterside system 120 can be located in or around building 10 (as shown in FIG. 1) or at an offsite location such as a central plant (e.g., a chiller plant, a steam plant, a heat plant, etc.). The working fluid can be heated in boiler 104 or cooled in chiller 102, depending on whether heating or cooling is required in building 10. Boiler 104 can add heat to the circulated fluid, for example, by burning a combustible material (e.g., natural gas) or using an electric heating element. Chiller 102 can place the circulated fluid in a heat exchange relationship with another fluid (e.g., a refrigerant) in a heat exchanger (e.g., an evaporator) to absorb heat from the circulated fluid. The working fluid from chiller 102 and/or boiler 104 can be transported to AHU 106 via piping 108.

AHU 106 can place the working fluid in a heat exchange relationship with an airflow passing through AHU 106 (e.g., via one or more stages of cooling coils and/or heating coils). The airflow can be, for example, outside air, return air from within building 10, or a combination of both. AHU 106 can transfer heat between the airflow and the working fluid to provide heating or cooling for the airflow. For example, AHU 106 can include one or more fans or blowers configured to pass the airflow over or through a heat exchanger containing the working fluid. The working fluid can then return to chiller 102 or boiler 104 via piping 110.

Airside system 130 can deliver the airflow supplied by AHU 106 (i.e., the supply airflow) to building 10 via air supply ducts 112 and can provide return air from building 10 to AHU 106 via air return ducts 114. In some embodiments, airside system 130 includes multiple variable air volume (VAV) units 116. For example, airside system 130 is shown to include a separate VAV unit 116 on each floor or zone of building 10. VAV units 116 can include dampers or other flow control elements that can be operated to control an amount of the supply airflow provided to individual zones of building 10. In other embodiments, airside system 130 delivers the supply airflow into one or more zones of building 10 (e.g., via supply ducts 112) without using intermediate VAV units 116 or other flow control elements. AHU 106 can include various sensors (e.g., temperature sensors, pressure sensors, etc.) configured to measure attributes of the supply airflow. AHU 106 can receive input from sensors located within AHU 106 and/or within the building zone and can adjust the flow rate, temperature, or other attributes of the supply airflow through AHU 106 to achieve setpoint conditions for the building zone.

Figure 2:
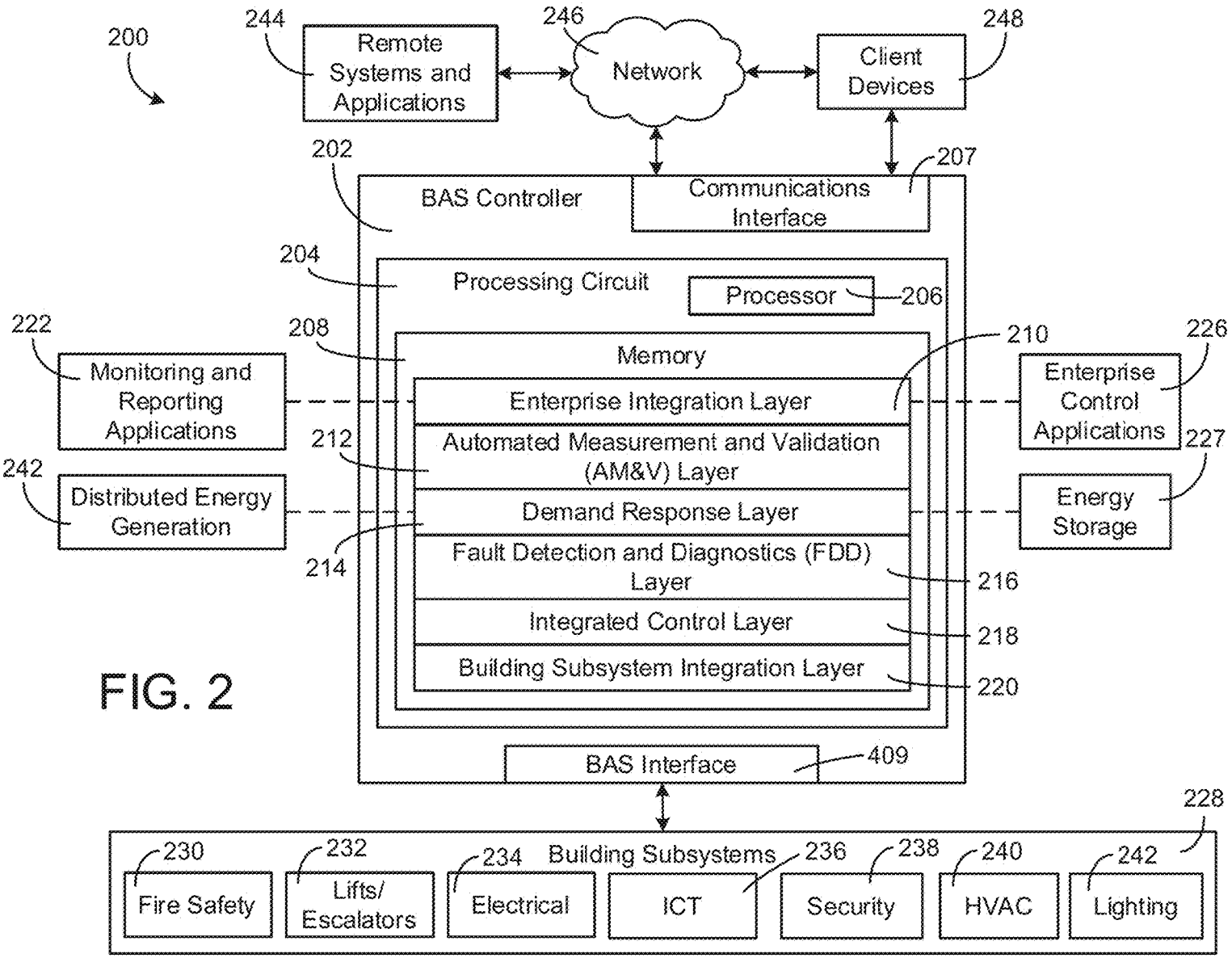
FIG. 2 is a block diagram of a building automation system (BAS) that may be used to monitor and/or control the building of FIG. 1, according to an exemplary embodiment.

Referring now to FIG. 2, a block diagram of a building automation system (BAS) 200 is shown, according to an exemplary embodiment. BAS 200 can be implemented in building 10 to automatically monitor and control various building functions. BAS 200 is shown to include building management system (BMS) or BAS controller 202 and building subsystems 228. Building subsystems 228 are shown to include a building electrical subsystem 234, an information communication technology (ICT) subsystem 236, a security subsystem 238, a HVAC subsystem 240, a lighting subsystem 242, a lift/escalators subsystem 232, and a fire safety subsystem 230. In various embodiments, building subsystems 228 can include fewer, additional, or alternative subsystems. For example, building subsystems 228 can also or alternatively include a refrigeration subsystem, an advertising or signage subsystem, a cooking subsystem, a vending subsystem, a printer or copy service subsystem, or any other type of building subsystem that uses controllable equipment and/or sensors to monitor or control building 10. In some embodiments, building subsystems 228 include a waterside system and/or an airside system. A waterside system and an airside system are described with further reference to U.S. patent application Ser. No. 15/631,830 filed Jun. 23, 2017, the entirety of which is incorporated by reference herein.

Each of building subsystems 228 can include any number of devices, controllers, and connections for completing its individual functions and control activities. HVAC subsystem 240 can include many of the same components as HVAC system 100, as described with reference to FIG. 1. For example, HVAC subsystem 240 can include a chiller, a boiler, any number of air handling units, economizers, field controllers, supervisory controllers, actuators, temperature sensors, and other devices for controlling the temperature, humidity, airflow, or other variable conditions within building 10. Lighting subsystem 242 can include any number of light fixtures, ballasts, lighting sensors, dimmers, or other devices configured to controllably adjust the amount of light provided to a building space. Security subsystem 238 can include occupancy sensors, video surveillance cameras, digital video recorders, video processing servers, intrusion detection devices, access control devices and servers, or other security-related devices.

Still referring to FIG. 2, BAS controller 202 is shown to include a communications interface 207 and a BAS interface 209. Interface 207 can facilitate communications between BAS controller 202 and external applications (e.g., monitoring and reporting applications 222, enterprise control applications 226, remote systems and applications 244, applications residing on client devices 248, etc.) for allowing user control, monitoring, and adjustment to BAS controller 202 and/or subsystems 228. Interface 207 can also facilitate communications between BAS controller 202 and client devices 248. BAS interface 209 can facilitate communications between BAS controller 202 and building subsystems 228 (e.g., HVAC, lighting security, lifts, power distribution, business, etc.).

Interfaces 207, 209 can be or include wired or wireless communications interfaces (e.g., jacks, antennas, transmitters, receivers, transceivers, wire terminals, etc.) for conducting data communications with building subsystems 228 or other external systems or devices. In various embodiments, communications via interfaces 207, 209 can be direct (e.g., local wired or wireless communications) or via a communications network 246 (e.g., a WAN, the Internet, a cellular network, etc.). For example, interfaces 207, 209 can include an Ethernet card and port for sending and receiving data via an Ethernet-based communications link or network. In another example, interfaces 207, 209 can include a Wi-Fi transceiver for communicating via a wireless communications network. In another example, one or both of interfaces 207, 209 can include cellular or mobile phone communications transceivers. In one embodiment, communications interface 207 is a power line communications interface and BAS interface 209 is an Ethernet interface. In other embodiments, both communications interface 207 and BAS interface 209 are Ethernet interfaces or are the same Ethernet interface.

Still referring to FIG. 2, BAS controller 202 is shown to include a processing circuit 204 including a processor 206 and memory 208. Processing circuit 204 can be communicably connected to BAS interface 209 and/or communications interface 207 such that processing circuit 204 and the various components thereof can send and receive data via interfaces 207, 209. Processor 206 can be implemented as a general purpose processor, an application specific integrated circuit (ASIC), one or more field programmable gate arrays (FPGAs), a group of processing components, or other suitable electronic processing components.

Memory 208 (e.g., memory, memory unit, storage device, etc.) can include one or more devices (e.g., RAM, ROM, Flash memory, hard disk storage, etc.) for storing data and/or computer code for completing or facilitating the various processes, layers and modules described in the present application. Memory 208 can be or include volatile memory or non-volatile memory. Memory 208 can include database components, object code components, script components, or any other type of information structure for supporting the various activities and information structures described in the present application. According to an exemplary embodiment, memory 208 is communicably connected to processor 206 via processing circuit 204 and includes computer code for executing (e.g., by processing circuit 204 and/or processor 206) one or more processes described herein.

In some embodiments, BAS controller 202 is implemented within a single computer (e.g., one server, one housing, etc.). In various other embodiments BAS controller 202 can be distributed across multiple servers or computers (e.g., that can exist in distributed locations). Further, while FIG. 2 shows applications 222 and 226 as existing outside of BAS controller 202, in some embodiments, applications 222 and 226 can be hosted within BAS controller 202 (e.g., within memory 208).

Still referring to FIG. 2, memory 208 is shown to include an enterprise integration layer 210, an automated measurement and validation (AM&V) layer 212, a demand response (DR) layer 214, a fault detection and diagnostics (FDD) layer 216, an integrated control layer 218, and a building subsystem integration later 220. Layers 210-220 is configured to receive inputs from building subsystems 228 and other data sources, determine optimal control actions for building subsystems 228 based on the inputs, generate control signals based on the optimal control actions, and provide the generated control signals to building subsystems 228 in some embodiments. The following paragraphs describe some of the general functions performed by each of layers 210-220 in BAS 200.

Enterprise integration layer 210 can be configured to serve clients or local applications with information and services to support a variety of enterprise-level applications. For example, enterprise control applications 226 can be configured to provide subsystem-spanning control to a graphical user interface (GUI) or to any number of enterprise-level business applications (e.g., accounting systems, user identification systems, etc.). Enterprise control applications 226 can also or alternatively be configured to provide configuration GUIs for configuring BAS controller 202. In yet other embodiments, enterprise control applications 226 can work with layers 210-220 to optimize building performance (e.g., efficiency, energy use, comfort, or safety) based on inputs received at interface 207 and/or BAS interface 209.

Building subsystem integration layer 220 can be configured to manage communications between BAS controller 202 and building subsystems 228. For example, building subsystem integration layer 220 can receive sensor data and input signals from building subsystems 228 and provide output data and control signals to building subsystems 228. Building subsystem integration layer 220 can also be configured to manage communications between building subsystems 228. Building subsystem integration layer 220 translate communications (e.g., sensor data, input signals, output signals, etc.) across multi-vendor/multi-protocol systems.

Demand response layer 214 can be configured to optimize resource usage (e.g., electricity use, natural gas use, water use, etc.) and/or the monetary cost of such resource usage in response to satisfy the demand of building 10. The optimization can be based on time-of-use prices, curtailment signals, energy availability, or other data received from utility providers, distributed energy generation systems 224, from energy storage 227, or from other sources. Demand response layer 214 can receive inputs from other layers of BAS controller 202 (e.g., building subsystem integration layer 220, integrated control layer 218, etc.). The inputs received from other layers can include environmental or sensor inputs such as temperature, CO2 levels, relative humidity levels, air quality sensor outputs, occupancy sensor outputs, room schedules, and the like. The inputs can also include inputs such as electrical use (e.g., expressed in kWh), thermal load measurements, pricing information, projected pricing, smoothed pricing, curtailment signals from utilities, and the like.

According to an exemplary embodiment, demand response layer 214 includes control logic for responding to the data and signals it receives. These responses can include communicating with the control algorithms in integrated control layer 218, changing control strategies, changing setpoints, or activating/deactivating building equipment or subsystems in a controlled manner. Demand response layer 214 can also include control logic configured to determine when to utilize stored energy. For example, demand response layer 214 can determine to begin using energy from energy storage 227 just prior to the beginning of a peak use hour.

In some embodiments, demand response layer 214 includes a control module configured to actively initiate control actions (e.g., automatically changing setpoints) which minimize energy costs based on one or more inputs representative of or based on demand (e.g., price, a curtailment signal, a demand level, etc.). In some embodiments, demand response layer 214 uses equipment models to determine an optimal set of control actions. The equipment models can include, for example, thermodynamic models describing the inputs, outputs, and/or functions performed by various sets of building equipment. Equipment models can represent collections of building equipment (e.g., subplants, chiller arrays, etc.) or individual devices (e.g., individual chillers, heaters, pumps, etc.).

Demand response layer 214 can further include or draw upon one or more demand response policy definitions (e.g., databases, XML files, etc.). The policy definitions can be edited or adjusted by a user (e.g., via a graphical user interface) so that the control actions initiated in response to demand inputs can be tailored for the user's application, desired comfort level, particular building equipment, or based on other concerns. For example, the demand response policy definitions can specify which equipment can be turned on or off in response to particular demand inputs, how long a system or piece of equipment should be turned off, what setpoints can be changed, what the allowable setpoint adjustment range is, how long to hold a high demand setpoint before returning to a normally scheduled setpoint, how close to approach capacity limits, which equipment modes to utilize, the energy transfer rates (e.g., the maximum rate, an alarm rate, other rate boundary information, etc.) into and out of energy storage devices (e.g., thermal storage tanks, battery banks, etc.), and when to dispatch on-site generation of energy (e.g., via fuel cells, a motor generator set, etc.).

Integrated control layer 218 can be configured to use the data input or output of building subsystem integration layer 220 and/or demand response later 214 to make control decisions. Due to the subsystem integration provided by building subsystem integration layer 220, integrated control layer 218 can integrate control activities of the subsystems 228 such that the subsystems 228 behave as a single integrated supersystem. In an exemplary embodiment, integrated control layer 218 includes control logic that uses inputs and outputs from building subsystems to provide greater comfort and energy savings relative to the comfort and energy savings that separate subsystems could provide alone. For example, integrated control layer 218 can be configured to use an input from a first subsystem to make an energy-saving control decision for a second subsystem. Results of these decisions can be communicated back to building subsystem integration layer 220.

Integrated control layer 218 is shown to be logically below demand response layer 214. Integrated control layer 218 can be configured to enhance the effectiveness of demand response layer 214 by enabling building subsystems 228 and their respective control loops to be controlled in coordination with demand response layer 214. This configuration can reduce disruptive demand response behavior relative to conventional systems. For example, integrated control layer 218 can be configured to assure that a demand response-driven upward adjustment to the setpoint for chilled water temperature (or another component that directly or indirectly affects temperature) does not result in an increase in fan energy (or other energy used to cool a space) that would result in greater total building energy use than was saved at the chiller.

Integrated control layer 218 can be configured to provide feedback to demand response layer 214 so that demand response layer 214 checks that constraints (e.g., temperature, lighting levels, etc.) are properly maintained even while demanded load shedding is in progress. The constraints can also include setpoint or sensed boundaries relating to safety, equipment operating limits and performance, comfort, fire codes, electrical codes, energy codes, and the like. Integrated control layer 218 is also logically below fault detection and diagnostics layer 216 and automated measurement and validation layer 212. Integrated control layer 218 can be configured to provide calculated inputs (e.g., aggregations) to these higher levels based on outputs from more than one building subsystem.

Automated measurement and validation (AM&V) layer 212 can be configured to verify that control strategies commanded by integrated control layer 218 or demand response layer 214 are working properly (e.g., using data aggregated by AM&V layer 212, integrated control layer 218, building subsystem integration layer 220, FDD layer 216, or otherwise). The calculations made by AM&V layer 212 can be based on building system energy models and/or equipment models for individual BAS devices or subsystems. For example, AM&V layer 212 can compare a model-predicted output with an actual output from building subsystems 228 to determine an accuracy of the model.

Fault detection and diagnostics (FDD) layer 216 can be configured to provide on-going fault detection for building subsystems 228, building subsystem devices (i.e., building equipment), and control algorithms used by demand response layer 214 and integrated control layer 218. FDD layer 216 can receive data inputs from integrated control layer 218, directly from one or more building subsystems or devices, or from another data source. FDD layer 216 can automatically diagnose and respond to detected faults. The responses to detected or diagnosed faults can include providing an alarm message to a user, a maintenance scheduling system, or a control algorithm configured to attempt to repair the fault or to work-around the fault.

FDD layer 216 can be configured to output a specific identification of the faulty component or cause of the fault (e.g., loose damper linkage) using detailed subsystem inputs available at building subsystem integration layer 220. In other exemplary embodiments, FDD layer 216 is configured to provide "fault" events to integrated control layer 218 which executes control strategies and policies in response to the received fault events. According to an exemplary embodiment, FDD layer 216 (or a policy executed by an integrated control engine or business rules engine) can shut-down systems or direct control activities around faulty devices or systems to reduce energy waste, extend equipment life, or assure proper control response.

FDD layer 216 can be configured to store or access a variety of different system data stores (or data points for live data). FDD layer 216 can use some content of the data stores to identify faults at the equipment level (e.g., specific chiller, specific AHU, specific terminal unit, etc.) and other content to identify faults at component or subsystem levels. For example, building subsystems 228 can generate temporal (i.e., time-series) data indicating the performance of BAS 200 and the various components thereof. The data generated by building subsystems 228 can include measured or calculated values that exhibit statistical characteristics and provide information about how the corresponding system or process (e.g., a temperature control process, a flow control process, etc.) is performing in terms of error from its setpoint. These processes can be examined by FDD layer 216 to expose when the system begins to degrade in performance and alarm a user to repair the fault before it becomes more severe.

Building Air Quality Assessment

Figure 3:
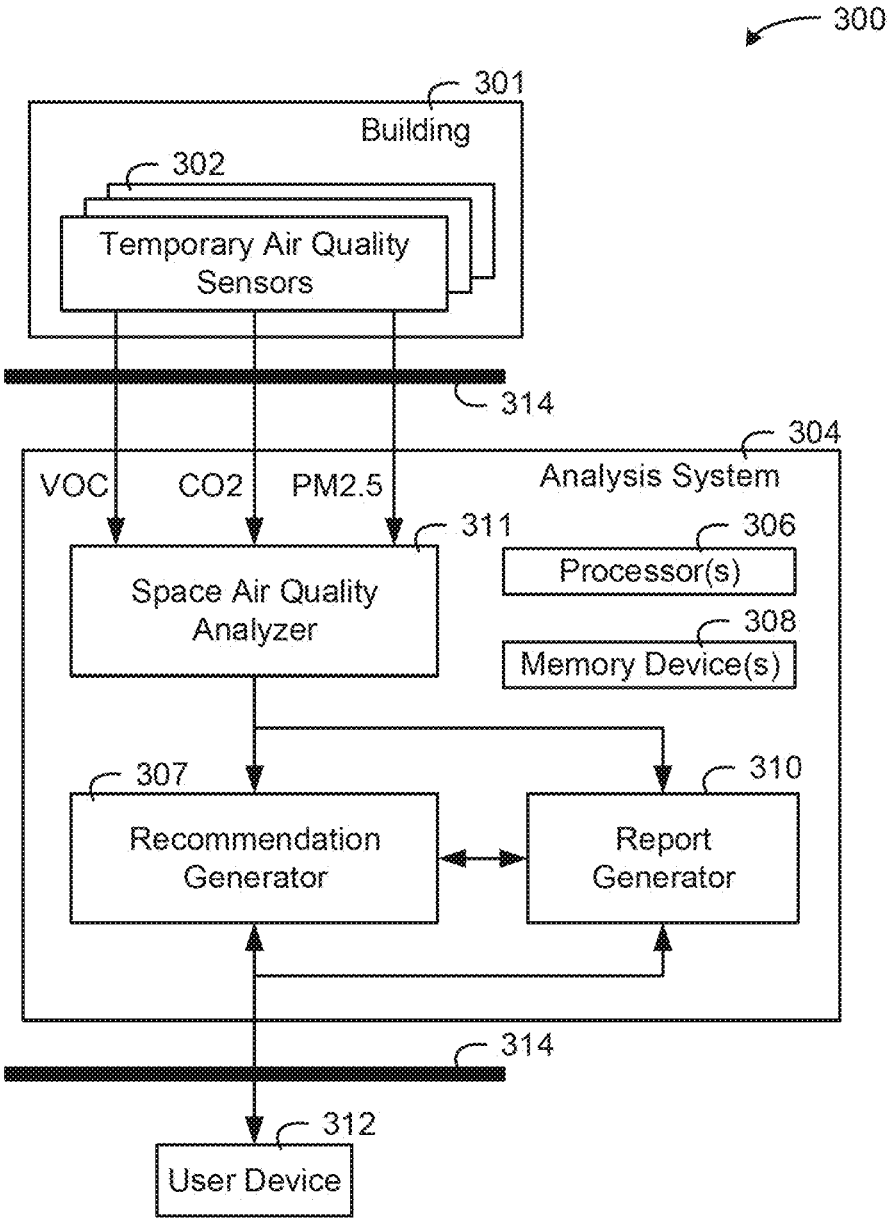
FIG. 3 is a block diagram of a building analysis system that generates recommendations and reports of spaces of a building based on air quality measurements of sensors, according to an exemplary embodiment.

Referring now to FIG. 3, a system 300 including an analysis system 304 that generates recommendations and reports for spaces of a building 301 based on air quality measurements of sensors 302 is shown, according to an exemplary embodiment. A technician can install the sensors 302 in the building 301 on a temporary basis, e.g., for one week, two weeks, a month, etc. The sensors 302 can be spread out through various spaces of the building 301 in order to record air quality measurements of each space of the building 301. The spaces of the building 301 can be or include rooms, zones, offices, classrooms, hallways, gymnasiums, orchestra rooms, concert halls, etc. In some embodiments, the building 301 can be an office building, a commercial building, an apartment building, a hospital, etc.

Each sensor of the temporary air quality sensors 302 can measure one or multiple air quality metrics, e.g., can include one sensor or a set of sensors. For example, the sensors 302 can measure ventilation for a space, occupancy for a space, CO2 for a space, particulate matter PM10 for a space, particulate matter PM2.5 for a space, volatile organic compounds (VOC) for the space, TVOC for the space, thermal measurements for the space, temperature for the space, relative humidity for the space, dew point for the space, ozone for the space, carbon monoxide (CO) for the space, formaldehyde for the space, etc. In some embodiments, the sensors 302 are permanent sensors that are installed in a permanent manner. In this regard, if the sensors 302 are permanent, the reports and/or recommendations can be generated based on data collected by the sensors 302 over a requested period of time, e.g., a particular day, week, year, etc.

The sensors 302 can communicate the measurements made by the sensors 302 to the analysis system 304 or a cloud platform that can perform an analysis on the air quality measurements of the various spaces of the building 301. For example, the sensors 302 can be wireless sensors (or wired sensors) that communicate across a network 314 which may include local networks within the building 301 and/or external networks. For example, various routers, switches, servers, cellular towers, LAN networks, WAN networks, Wi-Fi networks, Bluetooth communicating channels, 3G networks, 4G networks, 5G networks 6G, networks, etc. can be included within the network 314 and can communicate the measurements of the sensors 302 to the analysis system 304.

The temporary air quality sensors 302 can include processors, memory devices, processing circuits, network communication modules, or other components that can process the measurements collected by the temporary air quality sensors and communicate with a computing system and/or the analysis system 304. The processing and memory devices can be the same as or similar to the processors 306 and the memory devices 308. The network communication module can be the same as or similar to the communications interface 207 or the BAS interface 409. The processing systems of the temporary air quality sensors 302 can communicate with cloud systems, computing systems, computing devices, data processing systems, server systems, or other components via the network 314. The temporary air quality sensors 302 can communicate measurements directly to the analysis system 304 or to another computing system. The computing system can be separate from, integrated with, or the same as, the analysis system 304. The computing system can be configured to connect to, activate, collect measurements from, disconnect, or deactivate the sensors 302. The computing system can communicate collected measurements of the sensors 302 to the analysis system 304 for analysis and processing.

The computing system or the analysis system 304 can be configured to connect with the sensors 302 or activate the sensors 302. The computing system or analysis system 304 can transmit data, data packets, messages, commands, or other information to the sensors 302 to connect with the sensors 302. The sensors 302 can receive messages from the computing system or the analysis system 304 that instantiate or initiate a communication channel or tunnel with the sensors 302. The sensors 302 can be configured to connect with the computing system or the analysis system 304 responsive to receiving a message, data packet, or other piece of information from the computing system or the analysis system 304. The computing system or the analysis system 304 can activate the sensors 302. The sensors 302 can receive a command, message, or data packet that causes the sensors 302 to activate. The sensors 302 can activate responsive to receiving the data. The sensors 302 can activate by powering on, collecting sensor measurements, or transmitting the measurements to the computing system or the analysis system 304. The computing system or the analysis system 304 can disconnect from and/or deactivate the sensors 302. The computing system or the analysis system 304 can transmit a message, data packet, or command to the sensors 302 that cause the sensors 302 to disconnect from communicating with the computing system or the analysis system 304 or deactivate. The sensors 302 can be configured to disconnect from communicating with the computing system or the analysis system 304 and/or deactivate by stopping collecting measurements, powering off, etc.

Furthermore, information describing physical characteristics of the building 301 and various spaces of the building 301 can be provided to the analysis system 304 via a mobile application of a user device 312, a web browser of the user device 312, and/or any another application of the user device 312. The information can be manually collected site data, photos of the building 301, equipment information of the building 301, schematic diagrams or floor plans of the building 301, user information, desired metrics from the sensors 302, desired performance indications, floor plans of the spaces assessed via the sensors 302, AHU zone maps indicating each AHU and the spaces the AHUs serve, an AHU list/schedule indicating lists of AHUs with sizes and service information, etc. The user device 312 can be a smartphone, a tablet, a laptop computer, a desktop computer, etc. The user device 312 can communicate with the analysis system 304 via the network 314.

The analysis system 304 can be a cloud based system, a remote system, a local on-premises system with the building 301, a distributed processing system, or any other kind of computing system. The analysis system 304 can include one or multiple processors 306 and/or one or multiple memory devices 308. Processors 306 can be implemented as a general purpose processor, an application specific integrated circuit (ASIC), one or more field programmable gate arrays (FPGAs), a group of processing components, processing circuits, or other suitable electronic processing components.

Memory devices 308 (e.g., memory, memory unit, storage device, etc.) can include one or more devices (e.g., RAM, ROM, Flash memory, hard disk storage, etc.) for storing data and/or computer code for completing or facilitating the various processes, layers and modules described in the present application. Memory devices 308 can be or include volatile memory or non-volatile memory. Memory devices 308 can include database components, object code components, script components, or any other type of information structure for supporting the various activities and information structures described in the present application. In some embodiments, the memory devices 308 are communicably connected to the processors 306 via and the memory devices 308 include computer code for executing (e.g., by the processors 306) one or more processes described herein.

The analysis system 304 can include a space air quality analyzer 311, a recommendation generator 307, and a report generator 310. The space air quality analyzer 311 can record measurements of the various sensors 302 and create air quality profiles of the various spaces of the building 301. For example, the analyzer 311 can record air quality for the spaces and generate a trend over time (e.g., timeseries data or other time correlated data) in which the temporary sensors 302 are installed, e.g., over the two weeks that the sensors 302 are installed. The trends created by the analyzer 311 can be provided to the recommendation generator 307 and the report generator 310.

In some embodiments, the analyzer 311 can generate space hierarchy air quality information. For example, rooms, hallways, and closets may be basic units of space in the building 301. However, a hierarchy of spaces can be built from the basic space unit. For example, a group of rooms could form a zone of a floor. A group of zones could form a floor of a building. A group of floors could form a building of a campus. The analyzer 311 can generate low level space air quality metrics for basic space units. The analyzer 311 can generate higher level space air quality metrics for a particular space based on the basic space units that make up the particular space. For example, a CO2 metric for a floor could be generated by averaging the CO2 metrics for all rooms that make up the floor. Similarly, the CO2 metrics for a building could be made based on averaging CO2 metrics for all the floors of the building. In some embodiments, the metrics may be used to generate space health scores for the spaces (e.g., the rooms themselves, floors/buildings/campuses that include the rooms, etc.). In some embodiments, the space health scores may be specific to air quality. In some embodiments, the metrics may be used in combination with other metrics to generate an overall space health score. In some embodiments, the air quality metrics may be used in combination to generate a combined air quality health score, and that score may in turn be used as a component score to generate an overall space/building health score that includes air quality as a component. Example of such features that can be used in conjunction with the features of the present disclosure can be found in U.S. patent application Ser. No. 17/354,583, filed Jun. 22, 2021, and Ser. No. 17/354,565, filed Jun. 22, 2021, both of which are incorporated herein by reference in their entireties.

The report generator 310 can generate reports that summarize the air quality trends of the spaces of the building and/or include recommendations. For example, the charts and tables shown herein can be generated by the report generator 310 and included within a report generated by the report generator 310. The report generated by the report generator can provide the report to the user device 312 for review by a user. The report can further indicate areas of the building 301, recommendations for improving indoor air quality (IAQ) (e.g., reduce particular levels, reduce TVOCs to be below a particular threshold, etc.), recommendations for saving energy in the building 301 (e.g., reduce energy consumption of the building 301 to be less than a threshold), etc. In some embodiments, the report is a user interface including various charts, graphs, trends, recommendations, or other information. The interface can be displayed on a display device of the user device 312.

The report generator 310 can generate a report including recommendations generated by the recommendation generator 307 indicating actionable data that can be implemented by the system 304 and/or a BMS system of the building (e.g., the BMS system described in FIGS. 1-2). The recommendations can indicate a recommendation to improve ventilation in a room of the building 301 that requires additional ventilation (e.g., operate ventilation equipment to increase a ventilation rate), can recommend opportunities for energy savings where adjusting ventilation when a space is unoccupied would save energy (e.g., operate ventilation equipment to decrease a ventilation rate), recommendations which identify equipment which could provide better ventilation and/or filtering for spaces (e.g., install VAVs or unit ventilators (UVs) based on which type of equipment is performing better), assessments of adequacy of outdoor air filtration, recommendation to filter mixed air, etc. The report generator 310 can include a summary indicating key findings, testing details, testing results, photographs, conclusions, recommendations, etc.

The report generated by the report generator 310 can include a detailed building data summary report that indicates building size and use, recent renovation, special use areas, number of AHD's, filtration type and schedule, air supply system type, and specific areas of concern. The report can indicate a technicians visual inspection of representative AHD's, fan coil units, induction units, filter type/installation/condition, air supply diffusers, exhaust systems, and/or return air grilles. The report can indicate whether air systems of the building 301 are under proper control, a sequence of operations is being followed, and all controls are operating per the desired setpoint and schedule.

The report can include air quality tests of the sensors 302, e.g., CO2, CO, PM2.5, temperature, relative humidity, NO2, SO2, O3, VOC's, airflow vectors, air pressure differentials, etc. The report can indicate a ventilation assessment indicating the results of testing that ensures outside air intake, supply air fan, and/or ventilation system is supplying minimum outdoor air ventilation rate detailed by ASHRAE 62.1-2016. Ventilation needs based on space type, square footage, and occupancy. The report can indicate an infection risk assessment indicating DNA-tagged bioaerosols tracers safely simulate respiratory emissions to identify potential infection hotspots, verify ventilation and filtration system performance for mitigating airborne exposures, and optimize enhancements.

The recommendations generated by the recommendation generator 307 and included within the report generated by the report generator 310 can further include recommendations to investigate ventilation rates of rooms of the building 301 with CO2 levels above a particular level (e.g., 1100 ppm). The recommendations can indicate a current ventilation rate of a space along with comparisons to other ventilation rates of other spaces, inconsistencies can indicate that a user should consider adjusting the ventilation rates of the spaces. If all of the ventilation rates are similar, the recommendation can recommend changing a ventilation policy for the entire building 301. The recommendations could further be to analyze a source of TVOC for a space where TVOC is above a particular amount, investigate a source of VOCs in a space with TVOCs above a particular amount, etc.

The recommendations, in some embodiments, can include recommendations to improve ventilation, e.g., diluting dirty air with clean air as available from outside the building 301. This recommendation can ensure the delivery of ASHRAE required ventilation rates. The recommendations can be recommendations to improve filtration for spaces. Filtration may mechanically remove particles from the air of the space. The recommendation can be a recommendation to increase particle collection with options with filters such as Koch filters, MAC-10 fan filter units, enviro portable HEPA filtration units, etc.

The recommendations can include recommendations for improving disinfection for a space, e.g., deactivating bacteria and/or viruses in the space. The recommendations can be recommendations to install and/or operate disinfectant systems such as disinfectant light systems (e.g., ultraviolet (UV), ultraviolet-C (UVC), etc.). The recommendations can be recommendations to implement isolation of certain spaces of the building 301. The isolation can be achieved by locking or unlocking various doors of the building 301 to limit access of occupants of the building 301 to an isolated space. For example, cause one space to be an isolated space that contains particles and prevents the particles going elsewhere in the building 301. This can be implemented through creating a negative-pressure isolation environment. The recommendations can be recommendations for performing monitoring and maintenance of equipment, e.g., to inspect equipment frequently and/or track results for maintenance and monitoring to maintain clean air.

In some embodiments, the CO2 measurements of the sensors 302 can be used by the recommendation generator 307 to determine how well a space is being ventilated. If the CO2 levels are higher than particular amounts, a recommendation to increase ventilation can be generated and/or implemented. The TVOC measurements can indicate how safe a space is for human beings and/or animals. If TVOC is above a particular level, an alert can be generated to evacuate the space and/or address the high TVOC level. The PM2.5 levels can indicate how well filtering equipment is operating. If PM2.5 is greater than a particular amount, this may indicate that the space is not being properly filtered and that a filter of equipment serving the space needs to be replaced and/or changed to a higher quality filter.

In some embodiments, the recommendation generator 307 can perform an analysis on equipment type for the spaces. For example, the generator 307 could analyze spaces with low PM2.5 use unit ventilators while spaces with high PM2.5 use VAVs. This improvement in performance of the unit ventilators vs. the VAVs can be used in a recommendation for the recommendation generator 307 to recommend that unit ventilators replace the VAVS in the building 301.

In some embodiments, the recommendation generator 307 could recommend that persons with allergies be assigned to areas of a building with low VOC, TVOC, PM2.5, and/or PM10 levels. This may allow the allergenic persons to avoid having an asthma attack or other breathing problems. In some embodiments, class scheduling can be set up and/or recommended by the analysis system 304 such that students or teachers are not assigned spaces with high VOC, TVOC, PM2.5 levels for a long duration.

Figure 4:
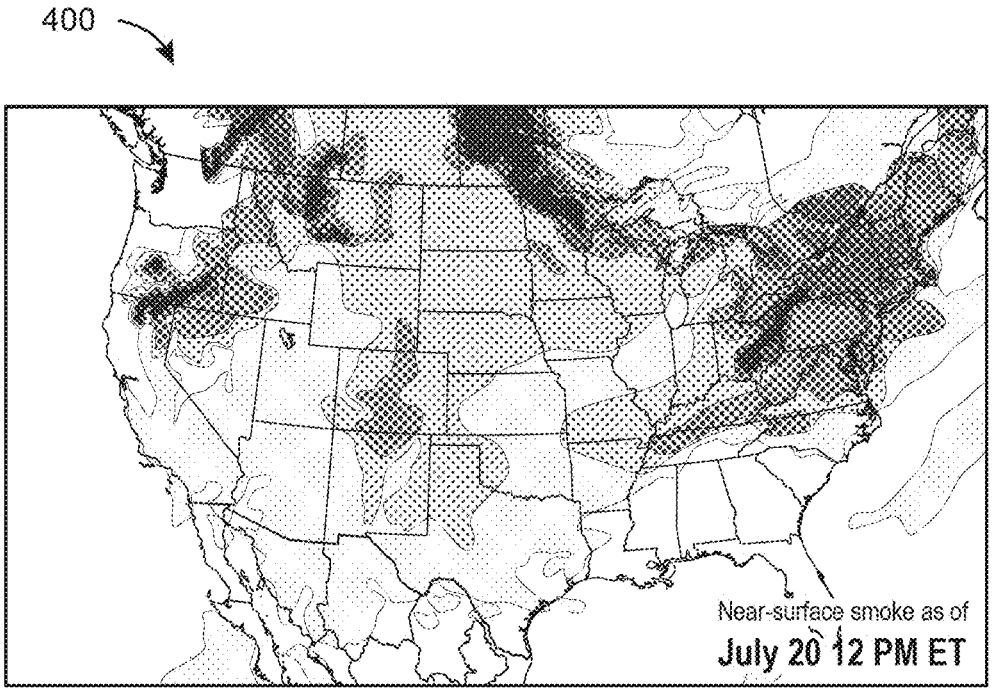
FIG. 4 is a drawing of smoke from fires moving across a country, according to an exemplary embodiment.
Figure 5:
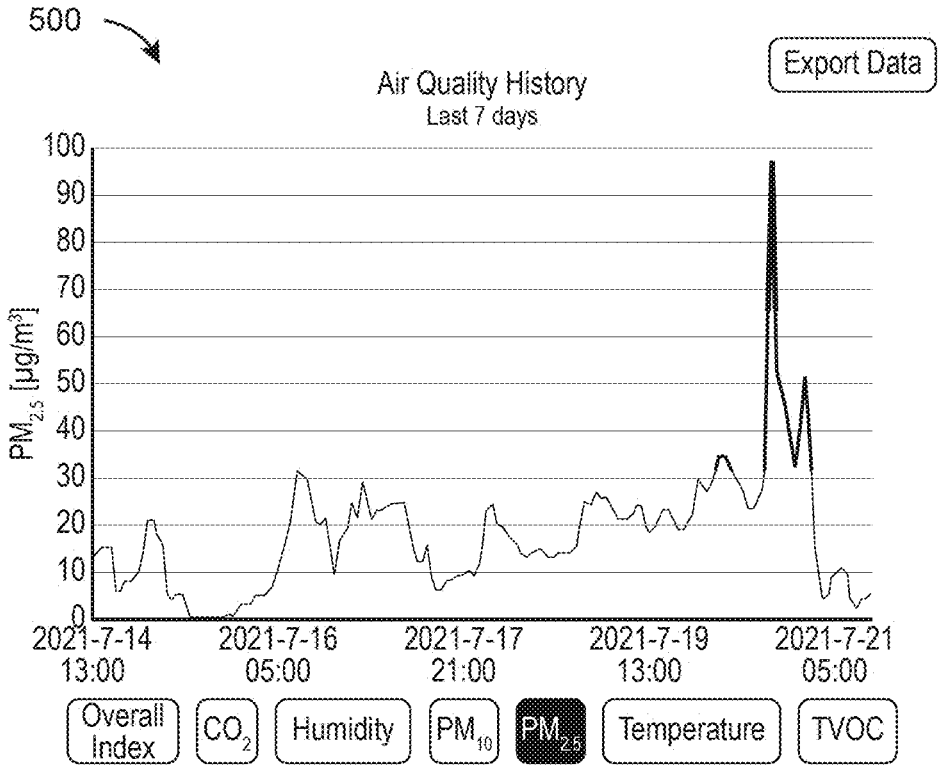
FIG. 5 is a chart of outdoor air quality corresponding to the smoke shown in FIG. 24, according to an exemplary embodiment.

Referring now to FIG. 4, a drawing 400 of smoke from fires moving across the United States, according to an exemplary embodiment. FIG. 5 indicates a chart 500 of PM2.5 particulate for the building 301. The outdoor air quality corresponds to the smoke shown in the drawing 2900. As can be seen, the spike in PM2.5 in the chart 500 corresponds to a smoke cloud from the fire in the drawing 400. In some embodiments, drawing 400 utilizes color gradients to denote the severity of smoke concentration, providing visual cues that can be used to infer the potential impact on air quality in various regions, including the vicinity of the building 301. Complementary meteorological data such as wind direction and speed might also be overlaid on the drawing 400, providing further context to the movement and dispersion of the smoke.

In some embodiments, the chart 500 can also incorporate secondary information alongside the primary PM2.5 data. For example, a line graph of estimated occupancy within the building 301 could be overlaid, potentially revealing correlations between occupancy levels and particulate matter concentrations. In particular, the analysis system 304 is configured to receive indoor air quality measurements from a multitude of sensors dispersed throughout various spaces within the building 301. These sensors continuously monitor the air quality within their respective environments, providing real-time data that is fed into the analysis system 304. Furthermore, the analysis system 304 is also configured to obtain data regarding outdoor air quality measurements. In some embodiments, the air quality metrics can be generated based on comparing the indoor air quality measurements with the outdoor air quality measurements. This comparative analysis can result in the generation of specific metrics, which include, but are not limited to, a ratio of the indoor air quality measurements to the outdoor air quality measurements.

For example, both indoor and outdoor PM2.5 levels could be recorded during a wildfire event. The outdoor PM2.5 levels may show a sharp increase due to the smoke from the wildfire as shown in drawing 400, which is reflected in the spike in the chart 500. The analysis system 304, upon receiving these measurements, can then compare the indoor and outdoor PM2.5 levels. If the indoor levels also show a significant spike, this could indicate that the smoke from the wildfire is penetrating the building and negatively impacting the indoor air quality. In response to this, the analysis system 304 can adjusting the HVAC system, such as increasing air filtration, reducing outdoor air intake, etc.

In another example, the analysis system 304 could compare outdoor PM2.5 measurements to indoor CO2 concentrations. In this example, during a high outdoor PM2.5 event like a wildfire, people inside the building 301 may choose to stay indoors to avoid the polluted air outside. Accordingly, this could lead to an increase in the indoor CO2 concentrations due to higher occupancy and human activity. The analysis system 304, monitoring these changes, might show an inverse correlation between outdoor PM2.5 and indoor CO2, as outdoor PM2.5 increases, so does indoor CO2. In this example, the analysis system 304 could implement of one or more control strategies to increase ventilation to reduce CO2 concentrations, while balancing the need to minimize the ingress of PM2.5 from outdoors.

Figure 6:
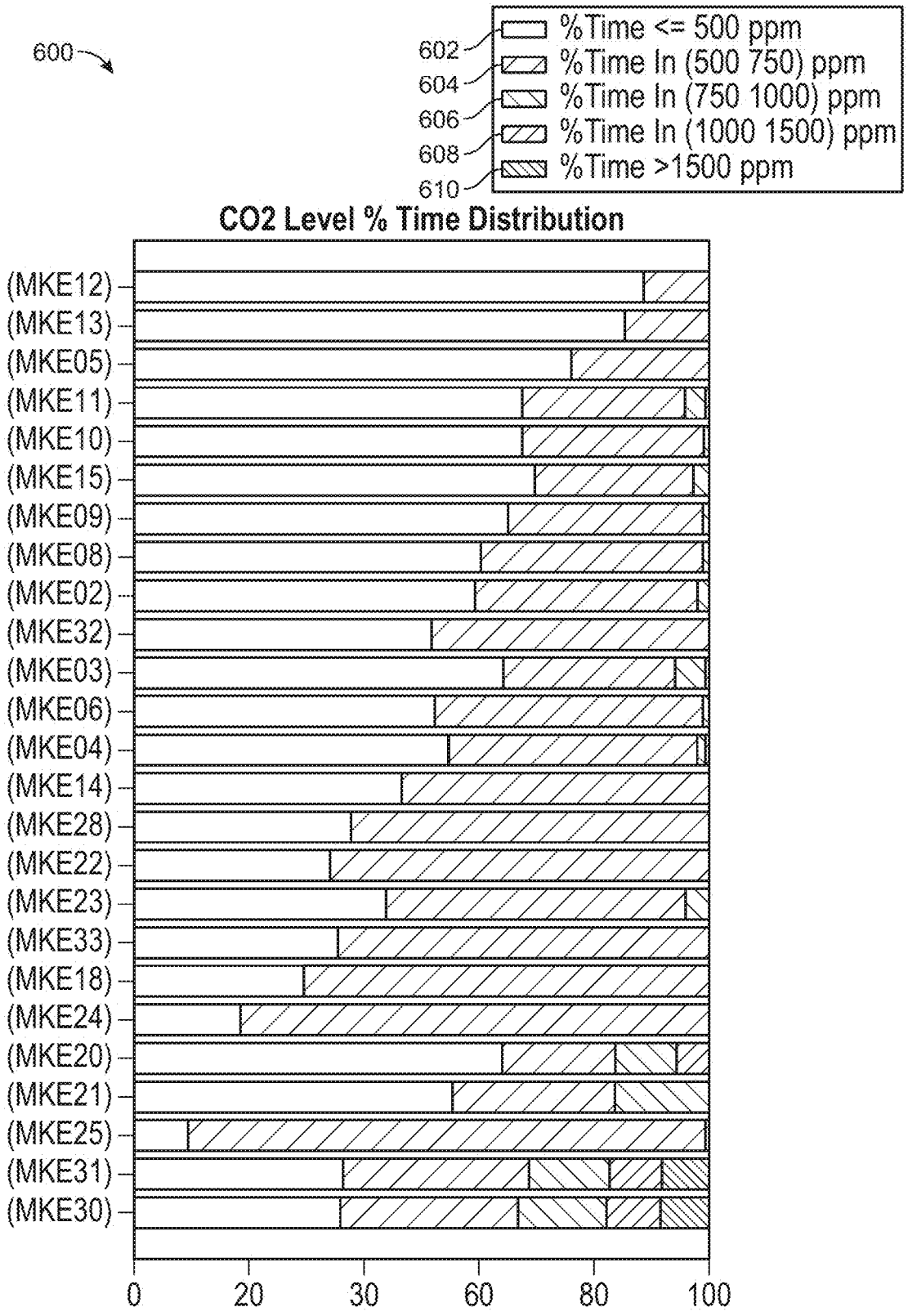
FIGS. 6-16 are graphical interfaces including interface objects, according to an exemplary embodiment.

Referring now to FIG. 6, a graphical interface 600 including interface objects, according to an exemplary embodiment. In particular, the graphical interface 600 includes a chart of CO2 measurements for spaces of a building, the chart indicating a percentage of time of a duration during a monitoring period (e.g., 1 day, 2 weeks, 1 month, 1 year) that each of the spaces had CO2 measurements in various ranges during the building's occupied period. In general, the duration can be the specific time period over which each space within the building has its CO2 levels measured. In some embodiments, the monitoring period is the timeline (e.g., 1 day, 2 weeks, 1 month, 1 year) in which these durations of measurements are taken. The duration could be a fraction of the monitoring period, such as an hourly measurement within a day or daily measurement within a year, providing snapshots of air quality at various points within the larger monitoring period.

In some embodiments, the graphical interface 600 compares the CO2 levels of various spaces with bars. The bars (i.e., interface objects) are divided up into components or sub-bars that are represented in various colors, patterns, or fills, the colors, patterns, or fills can indicate value ranges of CO2 during the building's occupied period. The amount of each color, pattern, or fill for each bar indicates the percentage of time that the CO2 level for the particular space is in a particular range. The components 602 indicate a low CO2 level, e.g., less than or equal to 500 ppm. The components 604 indicate a good (or low-medium) range of CO2 levels, e.g., from 500 ppm to 750 ppm. The components 606 indicate an acceptable (or medium) range of CO2 levels, e.g., 750 ppm to 1000 ppm. The components 608 and the components 610 (high) indicate that the areas require attention. The components 608 indicates CO2 levels in a range (medium-high) from 1000 ppm to 1500 ppm. The components 610 indicates CO2 levels in a range (high) greater than 1500 ppm.

As used herein, "air quality measurements" refer to the raw data points collected from a variety of sensors or systems distributed throughout the building. These measurements capture the physical and chemical characteristics of the air within the building over a specified duration during a monitoring period, giving an unfiltered perspective of the building's indoor environment. For example, air quality measurements can be, but is not limited to, total volatile organic compounds (TVOC), carbon dioxide (CO2), carbon monoxide (CO), nitrogen dioxide (NO2), sulfur dioxide (SO2), ozone, particulate matters, formaldehyde, fungi, lead (Pb), bacteria, protist, virus, or pathogen.

As used herein, "air quality metrics" refers to synthesized data developed from raw air quality measurements. The synthesis involves the application of IAQ performance metrics, providing a contextual representation of the raw data suitable for display on graphical interfaces. While these IAQ performance metrics are applied to the raw data, they do not necessarily adjust or alter it. Instead, they enrich the data by providing context. This context can be related to occupancy, the building system schedule, a building operating condition, or temporal representations of levels of air quality, facilitating a more comprehensive understanding of the building's air quality. For example, IAQ performance metrics can provide context on the occupancy (see FIGS. 7, 10, 12, 13), the parameters can provide context on the building system schedule (e.g., FIGS. 10, 14), the parameters can contextualize the raw data with respect to a building operating condition (e.g., FIGS. 6, 7, 8, 9, 10, 11, 13, 15, 16), or context can be provided through temporal representations of levels of air quality (e.g., FIGS. 7, 10, 11, 12).

As used herein, "IAQ performance metrics" refer to the set of criteria or variables used to modify the raw air quality measurements. These parameters serve to tailor the raw data in a way that enhances its presentation in the graphical interface. Such parameters can involve temporal factors, occupancy estimates, building operating conditions, and other elements that allow the air quality data to be better aligned with specific environmental contexts within the building.

Additionally, while the graphical interfaces illustrate the use of specific air quality measurements, it should be noted that any type of air quality measurements can be represented in the graphical interfaces. This could include, but is not limited to, CO2 concentrations, temperate and humidity levels, occupancy rates, Volatile Organic Acids (VoA), relative humidity, ozone levels, Nitrogen Dioxide (NO2) concentrations, formaldehyde levels, and even indicators such as radon, fungi, or allergen levels, among others.

In some embodiments, the graphical interface 600 may offer additional functionality such as the ability to overlay historical data (e.g., additional interface objects) for comparative analysis or to illustrate patterns over time. Furthermore, the graphical interface 600 could be equipped to generate alerts or notifications when the CO2 levels in specific spaces exceed predetermined thresholds, as indicated by a high prevalence of components 608 or 610. Such thresholds can be set in accordance with health guidelines or specific building policies. The graphical interface 600 might also be configured to provide an additional level of granularity by displaying the exact percentage of time spent in each CO2 range when a user hovers over the respective bars. Moreover, the graphical interface 600 could also offer the option to display data from selected or all sensors simultaneously. In some embodiments, spaces demonstrating a predominant presence of components 610 might warrant immediate attention, potentially calling for remedial measures such as enhanced ventilation, reduction in occupancy, updates to control strategies, updates to building operating conditions, etc. On the contrary, spaces characterized by a higher prevalence of components 602 and 604 might be deemed as optimal for occupation, signifying efficient air circulation and lower human density. Moreover, the graphical interface 600 could also include a time selector, allowing users to visualize the fluctuations in CO2 levels over different periods, which can prove essential in identifying trends, peak periods, or anomalies.

In the context of FIG. 6, the CO2 levels being monitored constitute the air quality measurements, the specified CO2 ranges serve as IAQ performance metrics, offering context to interpret the raw data. By placing these CO2 measurements into the defined ranges, air quality metrics can be generated, which are visually represented on the graphical interface 600 to facilitate an understanding of the building's air quality.

Figure 7:
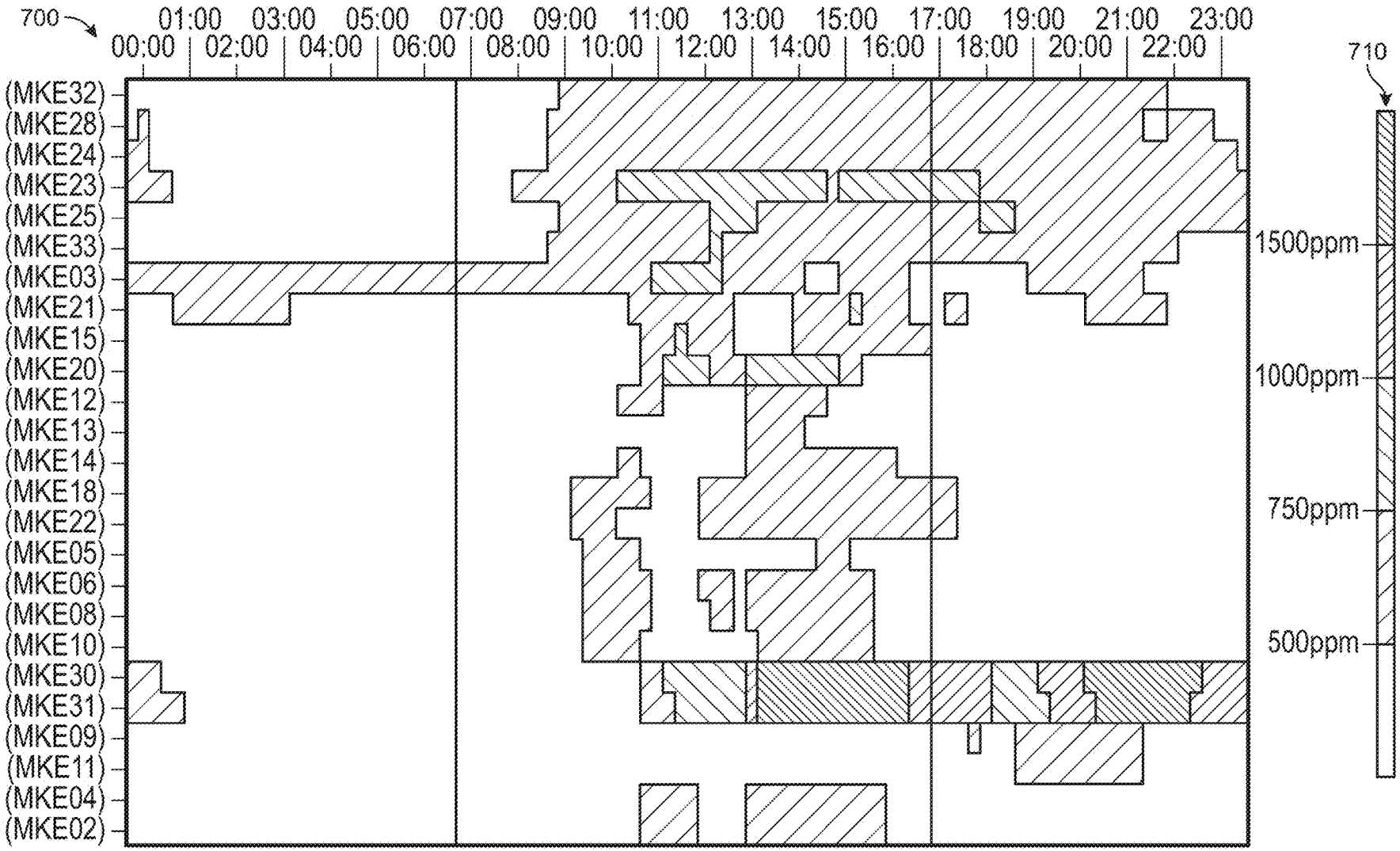

Referring now to FIG. 7, a graphical interface 700 including interface objects, according to an exemplary embodiment. In some embodiments, the graphical interface 700 depicts PMV levels based on the exemplary ASHRAE scale (e.g., predicted mean vote (PMV) to measure comfort) throughout a given time period or interval (e.g., hours, days, weeks). In graphical interface 700, the vertical axis (y-axis) can represent the given room in a building while the horizontal axis (x-axis) can represent increments of time throughout the day. In graphical interface 700, the vertical bars 702 and 704 indicate when the building's normal occupied times begin an end (e.g., 8:00 a.m. through 6:00 p.m. on business days). The graphical interface 700 may be automatically generated during a graphical interface generation step. Similar to FIG. 6, particular ranges 710 can be used in the graphical interface 700 to depict the time during the day that the CO2 level (i.e., interface objects) is within one of the particular ranges 710. In some embodiments, the graphical interface 700 may be used by an IAQ analyst (e.g., BAS controller 202, or a human log analyst) to form conclusions during the building's IAQ analysis. For example, in looking at the graphical interface 700 an IAQ analyst (e.g., BAS controller 202, or a human log analyst) may note that MKE30 and MKE31 often have elevated CO2 levels after 10 a.m. and is therefore under-ventilated or under-filtered.

In some embodiments, the graphical interface 700 might allow users to adjust (e.g., using actionable interface objects) the time scale on the horizontal axis, providing the flexibility to zoom into specific time periods or zoom out for a broader overview. The graphical interface 700 could also feature a functionality to superimpose external factors (e.g., additional interface objects), such as outside temperature or air quality, onto the existing PMV graph. This feature can offer a context to the IAQ analysis by illustrating the potential impact of external conditions on indoor air quality. Additionally, the graphical interface 700 might support annotations to allow IAQ analysts or the analysis system 304 to make notes directly on the graph, which can be beneficial when tracking the effectiveness of implemented changes or actions over time. With the bars 702 and 704 defining the typical occupied times, an additional layer of analysis could be introduced by highlighting periods of elevated CO2 levels outside these times. In some embodiments, this could indicate unauthorized occupancy or ventilation issues during off-hours. Additionally, the graphical interface 700 can also enable users to toggle between viewing PMV levels for individual rooms or a cumulative view for the entire building, depending on the scale of the analysis required.

In some embodiments, representations of the rooms (e.g., a floorplan with heatmap or other colors/illustrations) can be shown to represent the average measurements. This may take the visual form of a schematic drawing of a floor plan in a customer's building with set of labeled sensors for placement on the floor plan. In an exemplary embodiment, the room representations may be produced by the BAS controller 202 or by analysis system 304. The room representation may include labeled boxes that correspond to the sensors contained in a sensor kit for IAQ assessment. The sensor labels may be color coordinated to the sensor's average ASHRAE measurement for the room and/or zone. In an exemplary embodiment, the labeled boxes that represent the sensors contained in a sensor kit are automatically moved onto a schematic room representation to represent the location each sensor was placed in.

In some embodiments, while the graphical interfaces 600 and 700 specifically illustrate the use of CO2 measurements, it should be noted that any type of air quality measurements can be represented in an outlier chart on the graphical interface. This could include, but is not limited to, CO2 concentrations, temperate and humidity levels, occupancy rates, Volatile Organic Acids (VoA), relative humidity, ozone levels, Nitrogen Dioxide (NO2) concentrations, formaldehyde levels, and even indicators such as radon, fungi, or allergen levels, among others. In the context of FIG. 7, the CO2 levels, among other potential air quality measurements, would be the air quality measurements, delivering raw data from various rooms within the building. The specified CO2 ranges and time intervals would serve as IAQ performance metrics, providing context for the interpretation of the raw data. By organizing these measurements into defined ranges over the indicated time periods, the air quality metrics can be generated. These metrics can be visually displayed on the graphical interface 700, enabling an understanding of the air quality fluctuations in the building over the course of the day.

Figure 8:
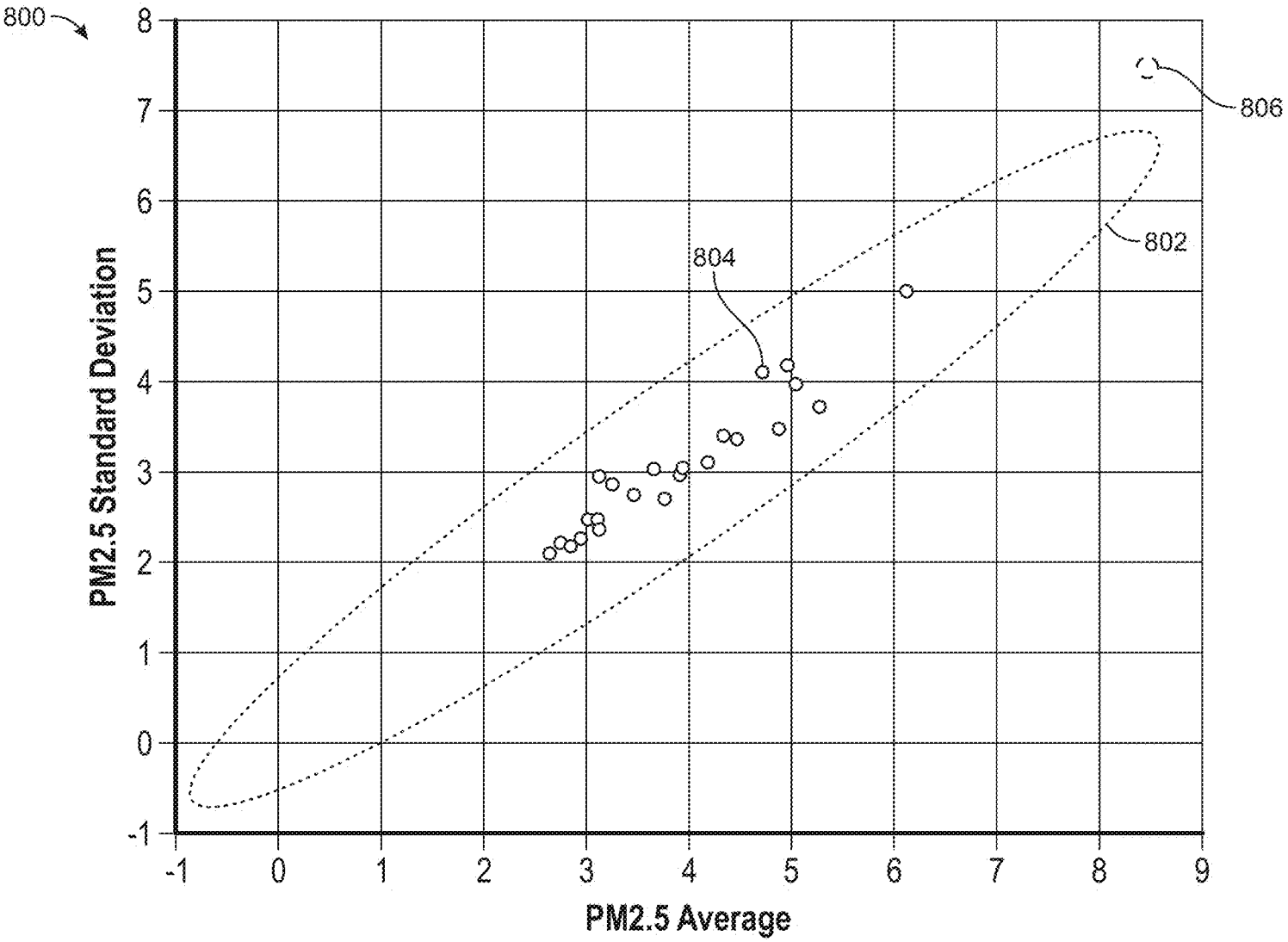
Figure 9:
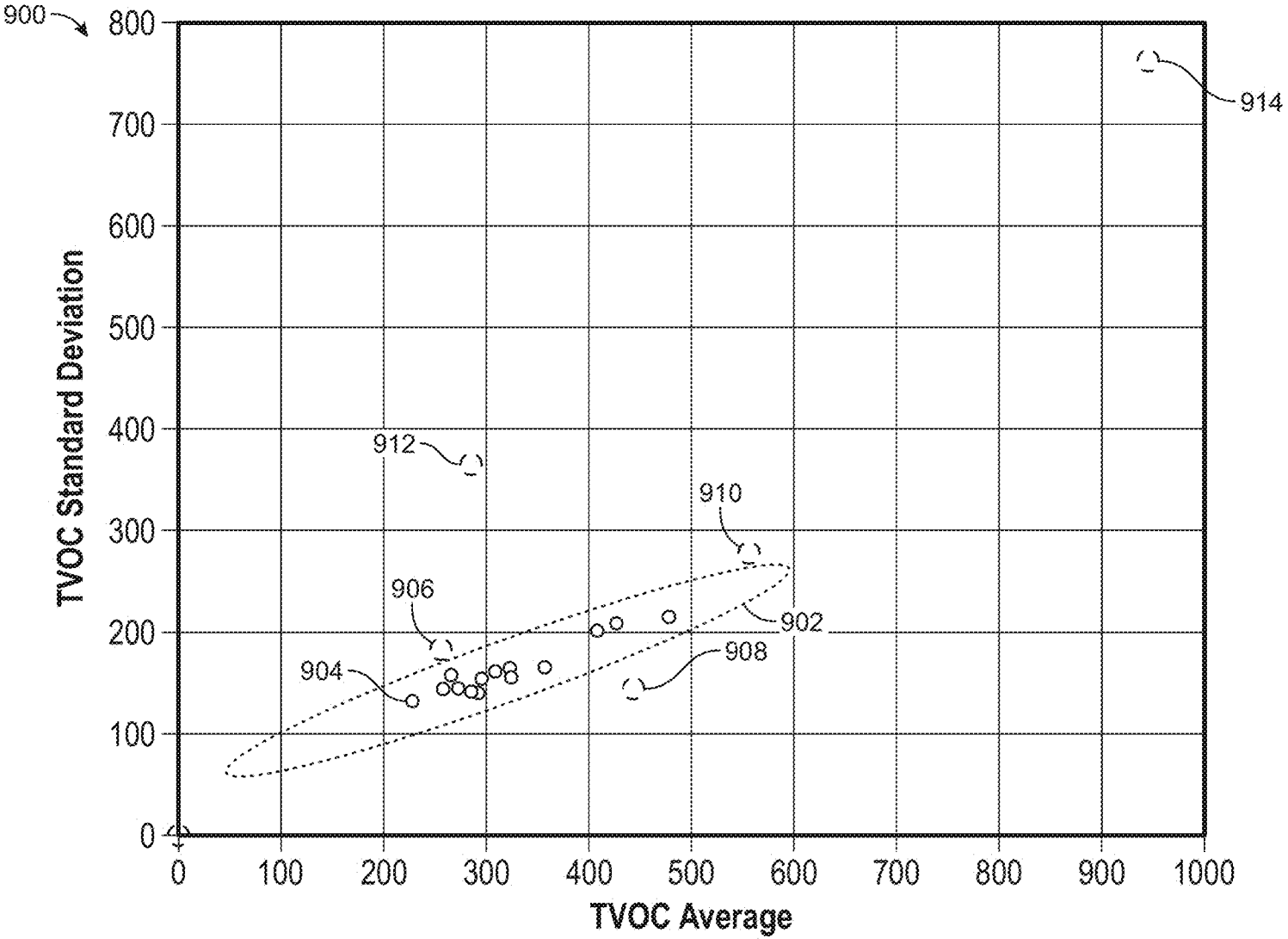

Referring generally to FIGS. 8-9, graphical interfaces including interface objects, according to exemplary embodiments. The graphical interfaces can include outlier charts (or scatter plots) on various IAQ values (e.g., CO2, TVOCs, PM2.5 levels, temperate and humidity levels, VoA, and occupancy) in a customer's building. In some embodiments, each of the points on the outlier chart represents a sensor placed in a room and/or zone in a customer's building. The vertical axis of the outlier chart represents the standard deviation of an IAQ measurement, while the horizontal axis represents the average IAQ value. The circles 802 and 902 represent the expected normal variation in the sensor readings. Points that fall out of the circles may represent spaces that warrant additional investigation. The generation of a graphical interface may be applied to any measured or calculated IAQ value collected from sensors 302.

Referring now to FIG. 8, which depicts a graphical interface 800 including an outlier chart on PM2.5 levels in a customer's building. As shown, the outlier room 806 represents a student center with PM2.5 values that are statistically different from the rest of the building. This detection may not directly indicate an issue, rather it warrants an investigation into room 806. If the graphical interface 800 shows that a room is an outlier on the chart, an IAQ analyst (e.g., BAS controller 202, or a human log analyst) may review the outlier for further analysis. Additionally, the rooms within circle 802, such as room 804, can indicate that the sensor readings are within an expected normal variation. In some embodiments, the graphical interface 800 serves as a real-time visualization tool to assess the PM2.5 levels in the various spaces of a building. The continuous monitoring of PM2.5 levels and their presentation in the form of a scatter plot provides an ongoing, view of the air quality. The consistent presence of room 806 as an outlier, for example, could suggest a deviation from the rest of the building without necessarily indicating a specific issue. The display of these fluctuations in real time can enable response and adjustment, aiding in maintaining optimal air quality throughout the building. Moreover, the standard deviation and average value representation on the chart can assist in identifying patterns over time, which could inform preventative measures and proactive maintenance strategies.

In some embodiments, the graphical interface 800 could offer several additional features aimed at enhancing the user's analysis capabilities. For example, it could allow users to change the scope of the chart by adjusting the range of PM2.5 levels on both axes. The graphical interface 800 could also include a time slider to visualize how the average and standard deviation of PM2.5 levels in various rooms evolve over time. Further, the graphical interface 800 might provide options to customize the shape, color, or size of the data points based on other variables, such as room size or occupancy level. In terms of outlier management, the graphical interface 800 might feature an alert mechanism that automatically flags rooms, such as room 806, with readings falling outside of the expected variation circle 802.

Referring now to FIG. 9, which depicts a graphical interface 900 including an outlier chart on TVOC levels in a customer's building. As shown, multiple rooms 906, 908, 910, 912, and 914 can be outliers with abnormal TVOC values, which may indicate that the rooms are having filtration issues. However, the analysis system 304 or BAS controller 302 may determine the issue to be a system wide or HVAC system issue given the number of outliers determined. Thus, if the graphical interface 800 shows that a plurality of rooms have an abnormal value on the outlier chart, an IAQ analyst (e.g., BAS controller 202, or a human log analyst) may review the outliers and generate an IAQ conclusion (e.g., the HVAC zones associated with the rooms needs to be repaired or updated to address the filtration issue). Additionally, the rooms within circle 902, such as room 904, can indicate that the sensor readings are within an expected normal variation.

In some embodiments, the graphical interface 900 offers a snapshot of the TVOC levels in the building spaces. Through a similar scatter plot representation as the graphical interface 800, it provides a view of the TVOC variance across different spaces. For example, the multiple outlier rooms such as 906, 908, 910, 912, and 914 signify possible ventilation or filtration issues in these zones. However, the high number of outliers could also suggest a broader issue at the system level. By visualizing the TVOC levels in real time, the graphical interface 900 allows for timely detection and rectification of air quality issues, thus ensuring a healthy and safe indoor environment. The ability to view the average and standard deviation of TVOC levels aids in trend identification and could provide input for air quality management plans.

In some embodiments, the graphical interface 900 could provide similar functionalities tailored to the analysis of TVOC levels. The interface might allow users to apply different statistical models to define the expected normal variation, represented by the circle 902. This could cater to different analysis approaches or accommodate distinct building characteristics. Additionally, when multiple outliers are identified, like rooms 906, 908, 910, 912, and 914, the interface might support a comparative analysis feature. This would allow users to simultaneously review the historical TVOC readings of these rooms to identify common patterns or events that might explain the abnormal values. In cases where a system-wide issue is suspected, the interface could also offer a function to overlay HVAC system operation data onto the outlier chart. This additional layer of data might provide further insights into the relationship between the HVAC system performance and the observed TVOC levels in the rooms.

In some embodiments, while the graphical interfaces 800 and 900 specifically illustrate the use of PM2.5 and TVOC measurements, it should be noted that any type of air quality measurements can be represented in an outlier chart on the graphical interfaces 800 and 900. This could include, but is not limited to, CO2 concentrations, temperate and humidity levels, occupancy rates, Volatile Organic Acids (VoA), relative humidity, ozone levels, Nitrogen Dioxide (NO2) concentrations, formaldehyde levels, and even indicators such as radon, fungi, or allergen levels, among others. In the context of FIGS. 8-9, the PM2.5 values serve as the air quality measurements, capturing specific data on particulate matter in each room or zone of the building. The utilization of average values and standard deviations function as IAQ performance metrics, supplying a means to interpret the raw PM2.5 data. These measurements, when computed become the air quality metrics that are then graphically plotted in graphical interfaces 800 and 900.

Figure 10:
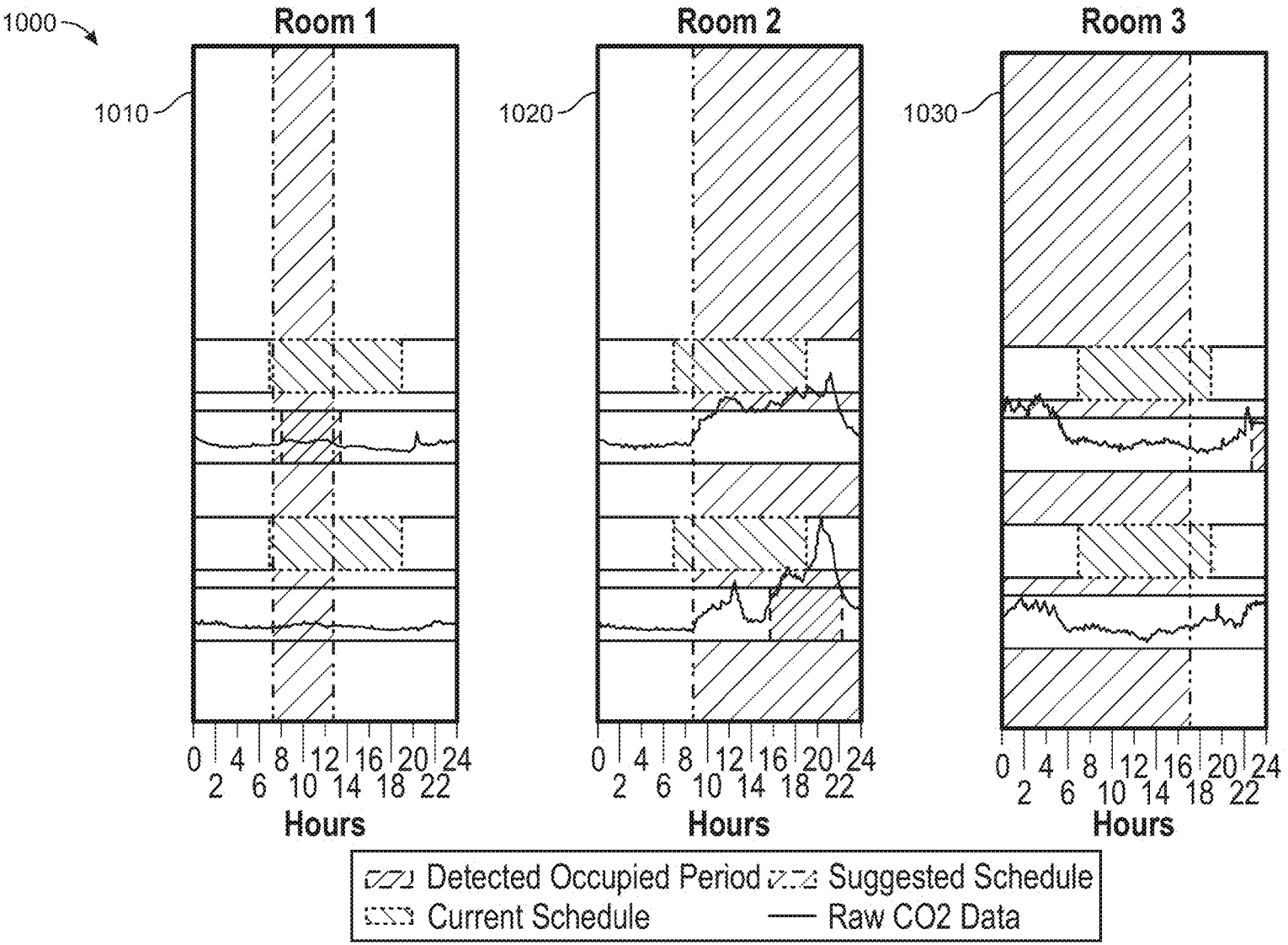

Referring now to FIG. 10, a graphical interface 1000 including interface objects, according to an exemplary embodiment. As shown, the graphical interface 1000 can include a plurality of operating schedule charts 1010, 1020, and 1030. Each operating schedule chart can include various areas or regions. In some embodiments, each of the charts or graphics can include a detected occupied period (e.g., determined based on occupancy estimates and/or air quality measurements), a current schedule (e.g., current building operating schedule), raw CO2 data (e.g., shown as a line starting at time 0 (midnight), and going until 24 (or midnight), and then a suggested schedule. For example, insights from the CO2 measurements indicate that the HVAC systems is over-scheduled (operating longer than necessary) compared to the detected occupancy. In this example, the analysis system 304 can recommended that the HVAC system's operating schedules be updated to the following, all spaces except Room 3 and Room 2, occupied from 7:00a.m.-1:00 p.m. every day, room 2 is occupied from 9:00 a.m.-12:00 a.m. every day, and room 3 is occupied from 12:00 a.m.-5:00 p.m. every day. That is, during occupancy of the rooms the suggested schedule can be provided. In this example, the recommendation is based on the IAQ audit data or air quality metrics. As such, due to the building type, occupancy may vary, so operating schedules may need to be modified to reflect those variations.

In some embodiments, the graphical interface 1000 allows for a visualization of the duration of operation of the HVAC system in the building for specific spaces such as Room 1, Room 2, and Room 3. It can provide an analysis between the detected occupied periods and the current schedule of the HVAC system. The detected occupied periods can be determined through occupancy estimates and air quality measurements taken throughout the day. In some embodiments, the graphical interface 1000 could also demonstrate the suggested schedule based on the analyzed data. The suggested schedule takes into account the patterns of occupancy and the air quality measurements to suggest optimized operational times for the HVAC system for each space. For example, in Room 2, the suggested schedule may propose operations from 9:00 a.m. to 12:00 a.m. based on detected occupancy patterns. Accordingly, the use of suggested schedules is to enhance the energy efficiency of the HVAC system by minimizing the operational time while still maintaining optimal indoor air quality.

As shown, the suggested schedule is not a replica of the detected occupied period because maintaining indoor air quality involves more factors than just occupancy. The suggested schedule is a result of an analysis of various parameters, such as the raw CO2 data and possibly other environmental factors like humidity, temperature, or outdoor air quality. Additionally, HVAC systems often need some lead time to condition the air within a space before the arrival of occupants. Hence, the suggested schedule might start earlier than the detected occupancy time to ensure the indoor environment is comfortable right at the start of occupancy. The adjustment of the schedule is also influenced by the goal of minimizing the HVAC system's operational time while ensuring optimal indoor air quality, which may not align perfectly with occupancy times. As an example, if the raw CO2 data for Room 2 shows a consistent increase around 8:30 a.m., although the detected occupancy does not start until 9:00 a.m., the suggested schedule may propose beginning the HVAC operation at 8:00 a.m. This would allow enough time for the system to stabilize the CO2 levels and ensure a comfortable indoor environment right at the start of the occupancy period. Meanwhile, if the raw CO2 levels do not significantly increase until 1:00 p.m. even though the room remains occupied, the HVAC system could potentially reduce its operation intensity or even stop operating for a while after 9:00 a.m., thus saving energy without including indoor air quality.

In some embodiments, while the graphical interface 1000 specifically illustrate the use of raw CO2 measurements, it should be noted that any type of air quality measurements can be represented in operating schedule charts on the graphical interface 100. This could include, but is not limited to, CO2 concentrations, temperate and humidity levels, occupancy rates, Volatile Organic Acids (VoA), relative humidity, ozone levels, Nitrogen Dioxide (NO2) concentrations, formaldehyde levels, and even indicators such as radon, fungi, or allergen levels, among others. In the context of FIG. 10, the raw CO2 data is the air quality measurements, while the detected occupied period and the current schedule function as IAQ performance metrics. The air quality metrics would be the suggested schedule overlayed/underlaid on other air quality metrics detected occupied period, current schedule, and raw CO2 data, that are then graphically plotted in graphical interface 1000.

Figure 11:
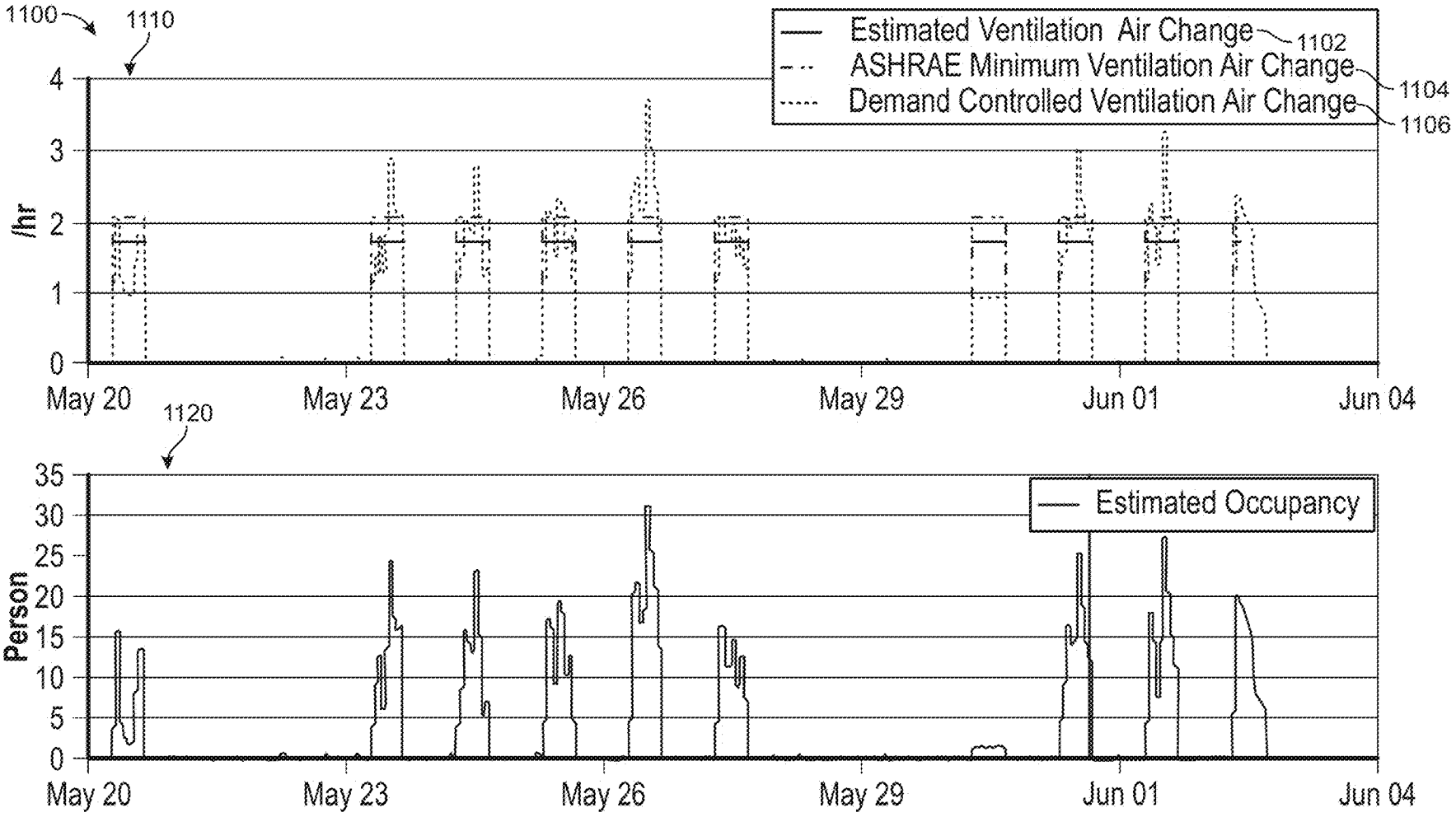

Referring now to FIG. 11, a graphical interface 1100 including interface objects, according to exemplary embodiments. The graphical interface 1110 depicts a set of graphical representations of a room and/or zone's estimated ventilation air change, ASHRAE minimum ventilation air change, and demand controlled air change. The graphical representations representing the estimated ventilation air change (shown as 1102), ASHRAE minimum ventilation air change (shown as 1104), demand controlled ventilation air change (shown as 1106) (collectively the first sample plot 1110) and estimated occupancy (the second sample plot 1120) are shown. In an exemplary embodiment, the estimated ventilation air change is represented by a plot 1102 and is graphed based on air changes per hour. In an exemplary embodiment, a plot 1006 represents what the demand controlled ventilation air change would be if controlled for the number of people in the room and/or zone. A set of ventilation details on the room and/or zone, including estimated VOA during occupied hours, uncertainty, ASHRAE suggested VOA, optimal VOA, power consumption needed to reach ASHRAE standard, and power savings from demand controlled ventilation may also be included, according to an exemplary embodiment. The determination of air changes is described with further reference to U.S. Provisional Patent Application No. 63/347,949 filed Jun. 1, 2022, the entire disclosure of which is incorporated by reference herein.

In some embodiments, representations of the rooms in the building (e.g., room 1 shown in graphical interface 1100) can be shown to represent the average measurements. This may take the visual form of a schematic drawing of a floor plan in a customer's building with set of labeled sensors for placement on the floor plan. In an exemplary embodiment, the room representations may be produced by the experts, BAS controller 202, or by building analysis system 304. The room representation may include labeled boxes that correspond to the sensors contained in a sensor kit for IAQ assessment. The sensor labels can be color coordinated to the sensor's estimated occupancy for the room and/or zone. In an exemplary embodiment, the labeled boxes that represent the sensors contained in a sensor kit are automatically moved onto the floor plan to represent the location each sensor was placed in. In some embodiments, representations of buildings on a multi-building campus can be shown to represent average measurements. This may take the visual form of a schematic drawing of buildings on a customer's campus marked with where sensors have been placed throughout the campus, according to an exemplary embodiment. In an exemplary embodiment, the sensor placement markings are automatically moved onto the schematic drawing of the campus building layout to represent the location each sensor was placed in.

Figure 12:
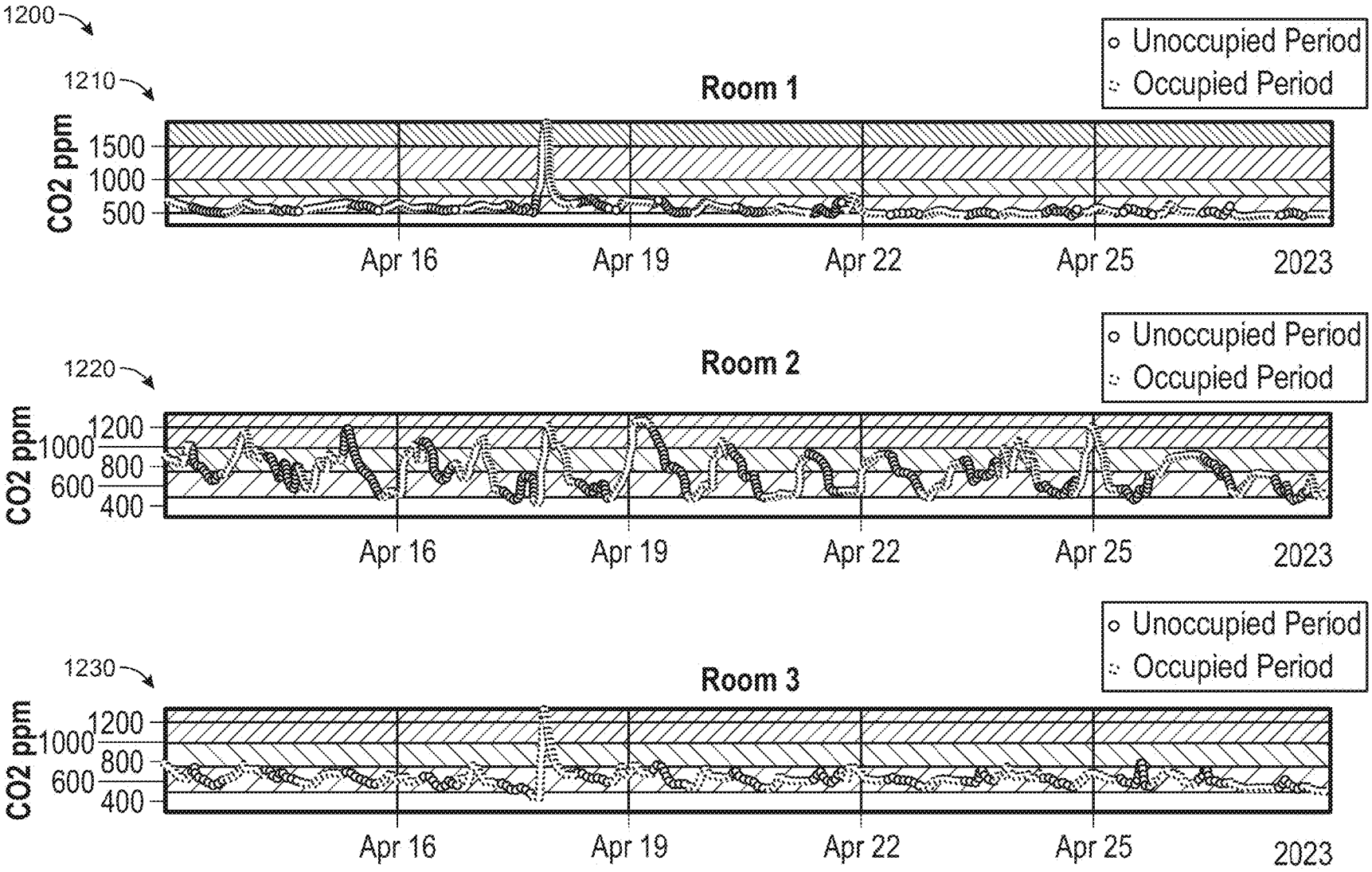

Referring now to FIG. 12, a graphical interface 1200 including interface objects, according to exemplary embodiments. As shown, a set of graphical representations 1210, 1220, and 1230 of summaries of a room's CO2 levels (alternatively, it could include TVOC, PM2.5, and/or PMV levels) over the assessment period. The key zone specifications like the width, height, use, maximum occupancy, and system type may also be included, according to an exemplary embodiment. As shown, the graphical representations include an indication when the room is occupied or unoccupied. For example, the CO2 levels can rise vertically (e.g., from around 800 ppm to above 1000 ppm) when the room is occupied and decrease or remain low when the rooms are unoccupied. In some embodiments, the graphical representation of the CO2 levels can be superimposed over a predefined scale or grid that demarcates various air quality ranges. For example, this grid could be analogous to the specific ranges denoted by particular ranges 710 in FIG. 7, serving as a reference for interpreting the plotted data. The implementation of such an interface enhances the readability of the interface, providing users with an immediate understanding of how the observed CO2 levels correspond to different air quality categories, and enabling them to make prompt and informed decisions about necessary interventions or modifications.

In some embodiments, graphical interface 1200 is employed to present an overview of a room's air quality parameters over a given assessment period. The graphical interface 1200 might utilize graphical representations such as bar charts, line graphs, or scatter plots to illustrate fluctuations in parameters like CO2, TVOC, PM2.5, and/or PMV levels. The temporal progression of these parameters can provide insights into patterns of occupancy and usage in the room. Moreover, the graphical interface 1200 may differentiate between occupied and unoccupied times through the use of color coding or different types of plot markers, making it visually evident when the room is in use or vacant. For example, when the room is occupied, the CO2 levels typically rise, signified by a steep vertical increase in the CO2 chart. Conversely, during unoccupied periods, these levels may decrease or remain low, as indicated by a downward trend or a stable, low line in the graphical representations 1210, 1220, and 1230. The inclusion of key zone specifications such as room dimensions (width and height), intended use, maximum occupancy, and HVAC system type can be further included in the graphical representations. These specifications can help users or system analysts contextualize the air quality data, facilitating more accurate interpretations and predictions. For example, larger room sizes may account for slower CO2 buildup, while a room with a higher maximum occupancy may show faster increases in CO2 levels during occupied periods. Such detailed representation enables the analysis system 304 to identify potential inconsistencies or anomalies in the air quality parameters, signaling the need for further investigation or corrective action.

In the context of FIG. 12, the raw CO2 ppm in each room and/or zone acts would be the air quality measurements. The measurements become more actionable when contextualized by IAQ performance metrics such as detected occupied periods and temporal representations. Furthermore, the air quality metrics materialize as data points in graphical interface 1200 indicating occupancy presence over time.

Figure 13:
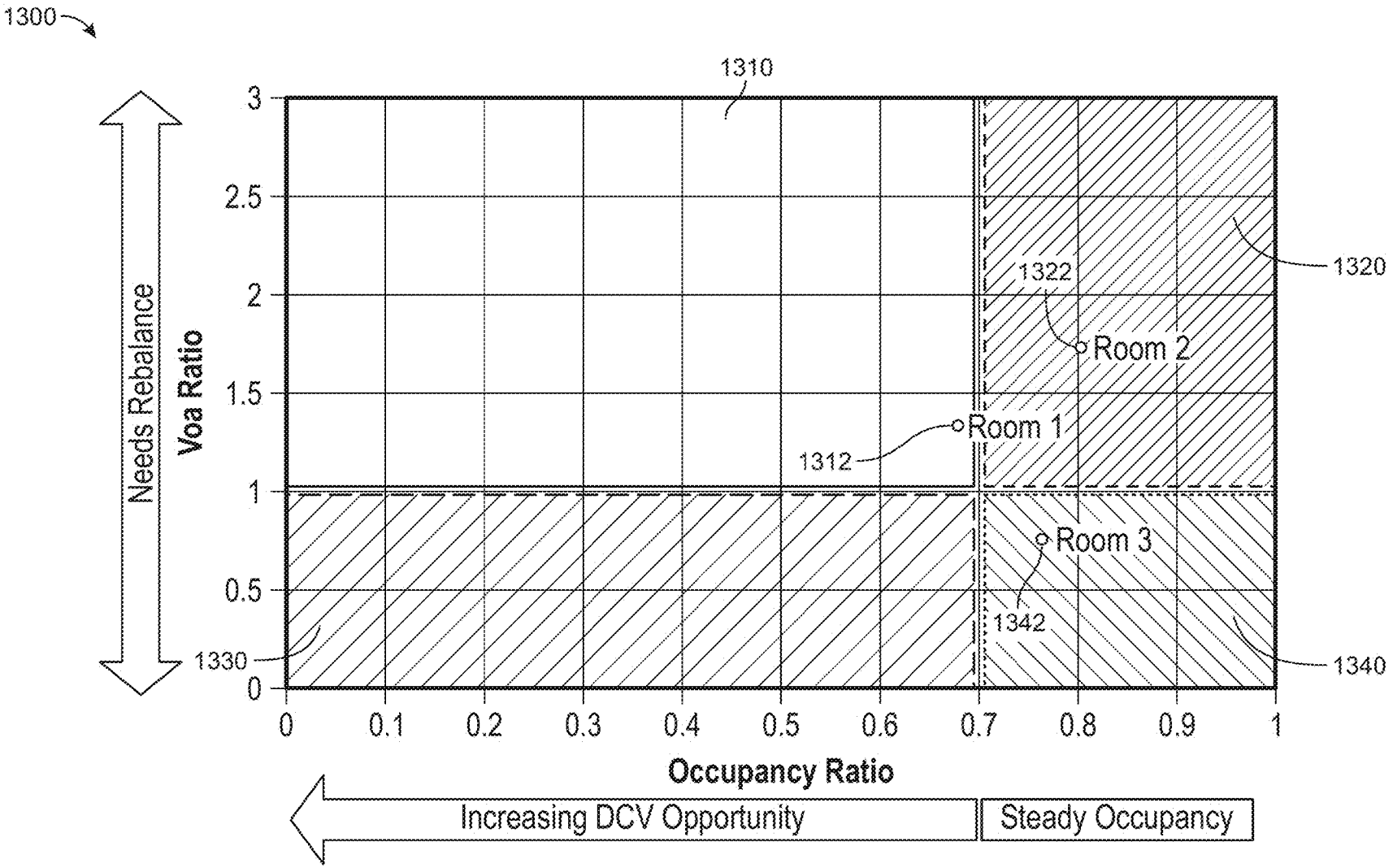

Referring now to FIG. 13, a graphical interface 1300 including interface objects, according to an exemplary embodiment. In some embodiments, the graphical interface 1300 includes a plurality of graphical areas (e.g., 1310, 1320, 1330, and 1340), where at least one of the plurality of graphical areas includes a ventilation-occupancy data point (e.g., 1312, 1322, 1342). In particular, each ventilation-occupancy data point (e.g., spaces) can correspond to a recommended ventilation action based on the estimated occupancy and at least one of the building system schedules or the building operating condition. As shown in graphical interface 1300, the x-axis is the ventilation to occupancy (Voa) ratio and the y-axis is the occupancy ratio. The Voa ratio is calculated by dividing the amount of ventilation (typically measured in cubic feet per minute or liters per second) by the occupancy level (usually the number of people in the space). In general, a Voa ratio greater than 1 would indicate that there is more than enough ventilation for the number of people in the space, suggesting an opportunity to decrease ventilation to save energy, especially when occupancy ratio is low. Conversely, a Voa ratio less than 1 would suggest inadequate ventilation for the number of people present, indicating an opportunity for an increase in demand-controlled ventilation (DCV) to improve the air quality. The occupancy ratio on the y-axis helps provide a reference point for these decisions.

In general, graphical area 1310 indicates zones that have variable occupancy and are overventilated i.e., analysis system 304 could implement DCV to improve energy savings), graphical area 1320 indicates zone that are overventilated (i.e., analysis system 304 could implement flow balancing for energy savings), graphical area 1330 indicates zone that have variable occupancy and are under ventilated when occupied (i.e., analysis system 304 could implement flow balancing to increase ventilation and implementing DCV to deliver ventilation at appropriate times), graphical area 1340 indicates zone that are under ventilated (i.e., analysis system 304 could perform flow balancing to improve IAQ). Graphical area 1310 corresponds to an area where the Voa ratio is greater than 1 and the occupancy ratio (less than 0.7) indicates an opportunity for an increase in DCV. Graphical area 1320 corresponds to an area where the Voa ratio is greater than 1 and the occupancy ratio indicates stead occupancy (e.g., greater than 0.7 occupancy ratio). Graphical area 1330 corresponds to an area where the Voa ratio is less than 1 (i.e., potential to rebalance) and the occupancy ratio indicates an opportunity for an increase in DCV. Graphical area 1340 corresponds to an area where the Voa ratio is less than 1 (i.e., potential to rebalance) and the occupancy ratio indicates stead occupancy.

In some embodiments, the graphical interface 1300 can be utilized in real-time to track and adapt to the changing environmental conditions in different rooms or zones within a building. This real-time adaptation can help in efficient utilization of the ventilation systems. For example, if the data point for a room moves into the graphical area 1310, indicating a Voa ratio greater than 1 with a lower occupancy ratio, the building management system could react by decreasing the ventilation for that room (i.e., updating a control strategy). This change can lead to energy savings while still maintaining adequate air quality. Conversely, if the data point for a room falls into graphical area 1340, representing a Voa ratio of less than 1 with a higher occupancy ratio, the building management system can increase ventilation in that room to ensure good air quality. In some embodiments, the graphical interface 1300 could also be used to generate a historical ventilation performance report. The report may contain information such as how often and to what extent the ventilation system was under or over performing in relation to the occupancy level. For example, a frequent occurrence of a room's data point in the graphical area 1340 (Voa ratio less than 1 and steady occupancy) may suggest a need for a review of the room's ventilation system for possible upgrades or adjustments. Similarly, a room's data point consistently falling in the graphical area 1310 (Voa ratio greater than 1 with lower occupancy) might signal an opportunity for optimizing the ventilation system to conserve energy without sacrificing indoor air quality.

In the context of FIG. 13, the estimated occupancy and ventilation rates in each room or zone would be the primary air quality measurements, while the Voa ratio, occupancy ratio, and the distinct graphical areas provide a contextual framework for these raw measurements. Furthermore, these data points, when mapped onto the graphical areas of interface 1300, become air quality metrics, giving a visual representation of the ventilation-occupancy balance in real-time and indicating areas of possible optimization in the building's ventilation system.

Figure 14:
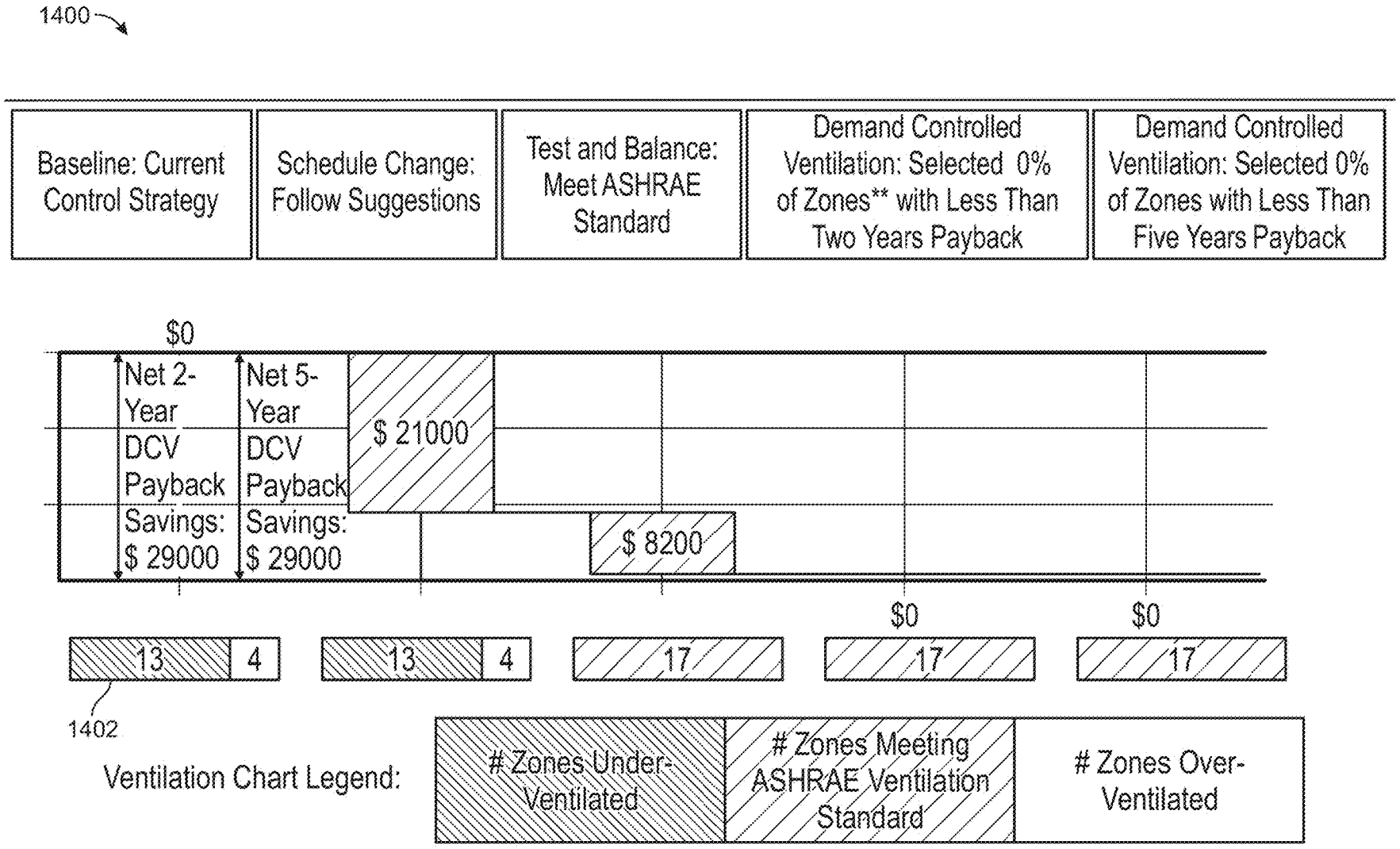

Referring now to FIG. 14, graphical interface 1400 including interface objects, according to an exemplary embodiment. As shown, one or more recommended actions can be presented in the graphical interface 1400. For example, the current control strategy is shown to include, in graphical element 1402, that 13 spaces of the building are under-ventilated and 4 spaces are over ventilated. Additionally, a schedule change could save $21,000 (e.g., per year, per month), yet the same amount of spaces are still under-ventilated and over-ventilated. Furthermore, a test and balance that meets ASHRAE standards would save the building $29,200/month and none of the spaces would be under-ventilated or over-ventilated. As shown, additional demand controlled ventilation (DCV) could be implemented without any additional cost savings.

In some embodiments, the graphical interface 1400 can serve as an interactive decision-making tool, assisting in selecting the most suitable control strategy based on the ventilation needs of different spaces within the building. For example, if an equal number of spaces are both under-ventilated and over-ventilated, the building management system might suggest rebalancing ventilation across spaces to optimize airflow. This can be accomplished without increasing overall ventilation, thus conserving energy while improving the ventilation effectiveness in under-ventilated spaces. As depicted in a graphical element, a rebalance meeting ASHRAE standards would result in significant cost savings and improved ventilation balance across the building.

Figure 15:
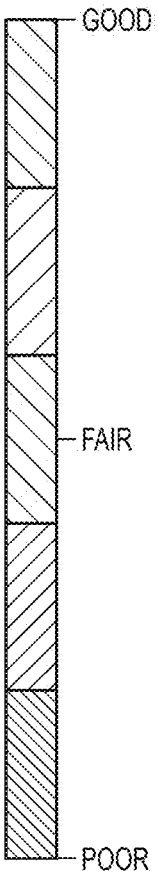

Referring now to FIG. 15, a graphical interface 1500 including interface objects, according to an exemplary embodiment. As shown, the ranges, similar to 710 of FIG. 7 can be depicted within a table across building and/or campuses. In some embodiment, the graphical interface 1500 can include a summary table of performance scores associated with temperature, RH, filtration, and ventilation across building. That is, instead of analyzing spaces in buildings, the graphical interface 1500 can include buildings across geographic areas and the table can be presented to present current and/or historical performance scores. For example, School A can have a temperature score of 5, RH score of 5, filtration score of 5, and ventilation score of 5, where the higher the score the poorer the performance is (i.e., between 1 and 5).

In some embodiments, the graphical interface 1500 can offer an analysis across different buildings, or even campuses, within a given network. This graphical interface 1500 allows for the breakdown of each key indoor air quality parameter—temperature, relative humidity (RH), filtration, and ventilation—and assigns a corresponding performance score. These performance scores, captured in a tabular format, allow for easy comparison of air quality metrics across different sites. For example, one building might excel in maintaining optimal temperature, but lack efficient filtration systems, reflected by a higher score in filtration. This way, the graphical interface 1500 facilitates the identification of the strong and weak areas in IAQ management across multiple sites. In some embodiments, the graphical interface 1500 can also present historical performance scores. This longitudinal analysis can assist in tracking the progression or regression of a building's indoor air quality management over time. For example, if the ventilation score of a certain school was consistently high in the past, indicating poor performance, but has been improved in recent months, this progress would be evident in the table (e.g., an indication in the box associated with ventilation with an arrow directed up or a plus sign, or other interface objects or elements).

In the context of FIG. 15, the raw measurements for temperature, RH, filtration, and ventilation would be the air quality measurements. The defined ranges work would be the IAQ performance metrics, offering context to these measurements. The scores derived from these measurements, presented in graphical interface 1500, would be the air quality metrics.

Figure 16:
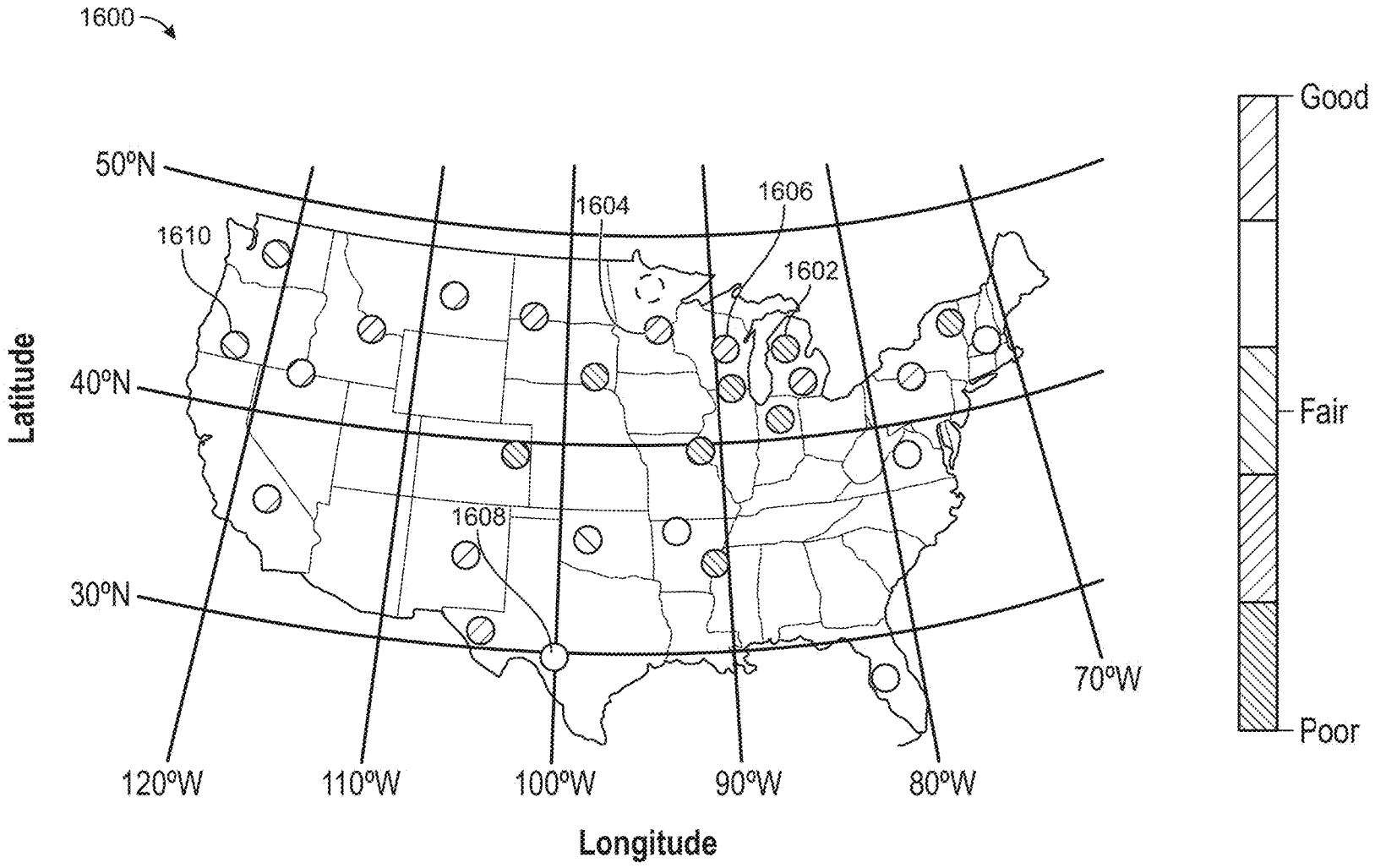

Referring now to FIG. 16, a graphical interface 1600 including interface objects, according to an exemplary embodiment. In some embodiments, a geographical map can be presented with data points (e.g., 1602, 1604, 1606, 1608, 1610) associated with a range (e.g., CO2 range, PM range, TVOC range, fungi range). As shown, each data point can be colored or filled in with an indication of the determined range. For example, the schools of FIG. 15 can be data points on the geographical map and the air quality measurements from each school can be collected and air quality metrics can be generated to determined one or more ranges associated with air quality of school. In some embodiments, the graphical interface 1600 provides a visual representation of geographical locations with corresponding air quality metrics. Each data point on the map corresponds to a specific location, such as a school, and carries information about the air quality at that location. These data points can incorporate multiple parameters, including but not limited to, carbon dioxide (CO2) levels, particulate matter (PM) concentrations, total volatile organic compounds (TVOC), and fungi ranges. By clicking on, or hovering over, these data points (i.e., interactable and/or actionable), users can retrieve detailed air quality information specific to each location.

In some embodiments, the visual differentiation among data points is made possible by employing different colors or patterns that indicate the determined air quality range. This color-coding or patterning system allows for a visual assessment of air quality status across various locations. For example, a data point filled with green may represent a school with excellent air quality measurements, whereas a red-filled data point may indicate poor air quality. Thus, at a glance, the graphical interface 1600 presents a comparative overview of air quality performance across different geographical locations. In some embodiments, the data points on the graphical interface 1600 can be dynamically updated based on the real-time air quality measurements collected from each location. As the IAQ audit system continues to collect and analyze air quality measurements, the ranges associated with each location, and thus their visual representation, can change accordingly. This means that the analysis system 304 can provide up-to-date air quality status for each location, enabling timely intervention when necessary. For example, if the air quality in a particular school deteriorates, this change would be reflected on the geographical map through the respective data point's color or pattern alteration, signaling the need for immediate attention and action (e.g., change in control strategy, modify building operating parameters, etc.).

In the context of FIG. 16, air quality data such as CO2 and PM obtained from different buildings serve as the air quality measurements. Context to these measurements is provided by the defined ranges and geographical locations, functioning as the IAQ performance metrics. The air quality metrics are represented by the data points associated with distinct colors or shades on the geographical map in graphical interface 1600.

Figure 17:
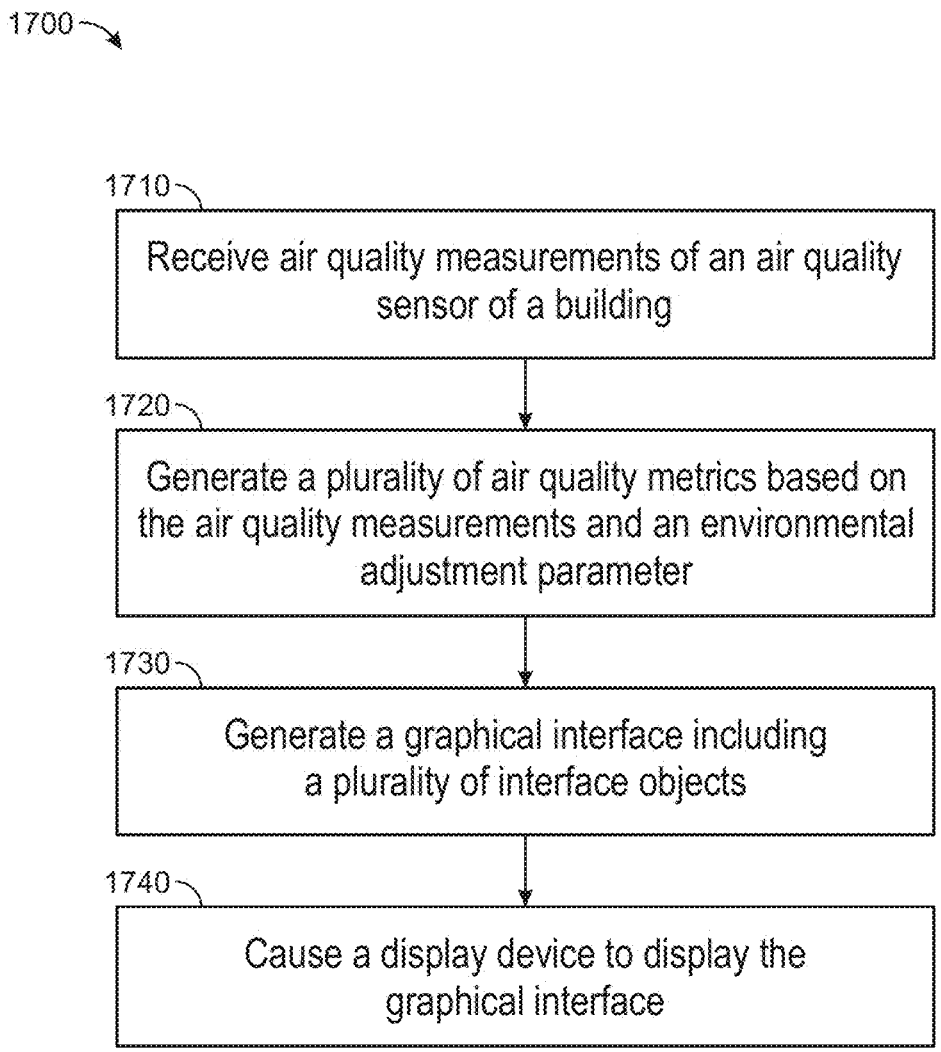
FIG. 17 is a flowchart for a method of building air quality assessment is shown, according to an exemplary embodiment.

Referring now to FIG. 17, a flowchart for a method 1700 of building air quality assessment is shown, according to some embodiments. Analysis system 304 or BAS controller 202 (both can be referred to herein as a "building analytical system") can be configured to perform method 1700. Further, any computing device described herein can be configured to perform method 1700.

In broad overview of method 1700, at 1710, the one or more processing circuits can receive air quality measurements of an air quality sensor of a building. At 1720, the one or more processing circuits can generate a plurality of air quality metrics based on the air quality measurements and an IAQ performance metric. At 1730, the one or more processing circuits can generate a graphical interface including a plurality of interface objects. At 1740, the one or more processing circuits can cause a display to display the graphical interface. Additional, fewer, or different operations may be performed depending on the particular arrangement. In some embodiments, some, or all operations of method 1700 may be performed by one or more processors executing on one or more computing devices, systems, or servers. In various embodiments, each operation may be re-ordered, added, removed, or repeated.

Referring to method 1700 in more detail, at block 1710, the one or more processing circuits can receive air quality measurements of at least a plurality of air quality sensors of a plurality of spaces of the building over a duration during a monitoring period. In some embodiments, block 1710 includes the extraction, collection, and identification of data from a multitude of air quality sensors installed throughout various spaces in a building over a period of time or duration (i.e., during a monitoring period) (e.g., one hour, one day, one week, etc.). These sensors may be capable of measuring a range of air quality parameters, such as CO2, TVOC, PM, humidity, temperature, and more. These devices can be continuously monitoring the air quality and transmitting this data to a centralized processing system for analysis. The wide range of measurements obtained allows for an overview of the air quality conditions across the entirety of the building. For example, in a school environment, sensors could be placed in classrooms, libraries, cafeterias, gyms, and offices to ensure a broad coverage.

In some embodiments, the data collected from these air quality sensors is time-stamped, providing the system with a temporal dimension for analysis. This allows for tracking changes in air quality measurements over time. These time-stamped data sets can be used to analyze air quality fluctuations during different periods of the day, on different days of the week, or even across different seasons of the year. For example, increased CO2 levels during school hours in comparison to non-school hours can indicate the effect of occupancy on air quality. In some embodiments, the data received by the processing circuits can also include metadata related to each of the air quality sensors. This can provide additional context to the air quality measurements, such as the location of the sensor within the building, the type of room where the sensor is located, the typical occupancy of that space, and other relevant information. This additional data layer can improve the air quality analysis, by associating the measurements with specific conditions of each space. For example, a sensor in a densely populated classroom may consistently report higher CO2 levels compared to a sensor in a rarely-used storage room.

In some embodiments, the processing circuits apply various statistical methods to the collected data to identify any potential outliers or errors. For example, if a particular sensor consistently reports significantly different measurements than other sensors in similar conditions, it may indicate a fault with that sensor, and its data could be temporarily excluded from the analysis until the issue is resolved. In some embodiments, block 1710 includes receiving indoor air quality measurements from the multitude of sensors installed within the building's spaces, and acquiring or collecting data pertaining to the outdoor air quality. Outdoor air quality sensors can be installed on or around the building to capture the ambient outdoor air quality conditions. Parameters such as particulate matter (PM), volatile organic compounds (VOCs), carbon dioxide (CO2), temperature, and humidity can be assessed. For example, on days when outdoor PM or VOC levels are high, it could be expected that indoor levels may also rise, particularly if the building's ventilation system draws in air from the outside.

In some embodiments, processing circuit can interface with a series of temporary air quality sensors that have been installed in various spaces across the building for a predetermined period. This facilitates short-term, monitoring of air quality parameters to support a detailed and precise analysis of the indoor environment. The processing circuit can connect to these sensors, receiving real-time or periodically updated data for the duration of their installation (i.e., during the monitoring period). At the end of this period, the processing circuit can disconnect from the temporary sensors. Accordingly, this allows for flexibility and adaptability in the monitoring approach, providing the ability to deploy additional sensors on a need basis for a comprehensive air quality assessment.

In some embodiments, the air quality measurements collected by the system may include, but are not limited to, data on total volatile organic compounds (TVOC), carbon dioxide (CO2), carbon monoxide (CO), nitrogen dioxide (NO2), sulfur dioxide (SO2), ozone, particulate matters, formaldehyde, fungi, lead (Pb), bacteria, protists, viruses, or pathogens. The range of potential air quality metrics provides an overview of the indoor environment, tracking the presence and concentration of various contaminants, pollutants, or potential health hazards. Each measurement can provide insights into different aspects of air quality, allowing the processing circuit to identify specific issues or potential areas of improvement in the building's air management system.

In some embodiments, with reference to block 1710, the building analytical system could be a cloud-based system that is situated remotely from the actual physical structure of the building. This cloud system can be designed to receive the air quality measurements from the deployed sensors via one or more wireless networks established within the building. The plurality of temporary air quality sensors that are installed throughout the spaces within the building are then configured to wirelessly communicate with the cloud system over these networks. This allows for real-time, remote monitoring and analysis of the air quality measurements.

At block 1720, the one or more processing circuits can generate a plurality of air quality metrics of the plurality of spaces based on the air quality measurements and at least one IAQ performance metric, wherein the at least one IAQ performance metric contextualizes the air quality measurements of the building over the duration during the monitoring period, and wherein the plurality of air quality metrics correspond to a plurality of ranges of air quality. These metrics are derived through a process that takes raw sensor readings like CO2 concentrations, volatile organic compounds, and particulate matter levels, and adjusts them based on relevant environmental factors such as temperature, humidity, and occupancy status. The IAQ performance metric serves to account for external influences on the air quality measurements, which could be anything from weather changes to construction activities nearby. By factoring in these environmental adjustments, the processing circuits produce a set of air quality metrics that offer a more accurate representation of the indoor air quality of the building.

Air quality metrics can be impacted by various IAQ performance metrics, such as temperature and occupancy status. For example, metrics related to particulate matter (PM) levels can be influenced by the ambient temperature. Thus, if air quality sensors detect an abrupt rise in PM concentration, and a concurrent spike in temperature, the processing circuit modifies the PM metric to account for this correlation. Similarly, the occupancy status of a space can affect metrics like carbon dioxide (CO2) levels. CO2 concentration typically surges in occupied spaces and drops when they're empty. If the CO2 levels suddenly rise, the processing circuit considers the occupancy data. If the room is confirmed as occupied, the resulting CO2 metric adjusts to reflect a typical increase due to human presence. However, if the room is empty, the CO2 metric indicates a potential anomaly.

In some embodiments, the air quality metrics generated from the air quality measurements can be utilized to create graphical interfaces, like those exemplified in FIG. 6 and FIG. 7. For example, as illustrated in FIG. 6, a variety of CO2 measurements from different spaces within a building can be processed into a bar chart. These air quality metrics are generated based on the percentage of time that each space had CO2 measurements within various ranges during a building's occupied period. Each air quality metric, represented as a specific range of CO2 levels, is graphically presented as a differently colored component of the bar representing a specific space. Similarly, in FIG. 7, the air quality metrics based on PMV (Predicted Mean Vote) levels are visualized throughout a given time period. These metrics, created from PMV measurements, can be used to generate a timeline chart where the vertical axis corresponds to the rooms in the building and the horizontal axis represents time intervals throughout the day. Color-coded ranges within this graphical interface can represent the times during which the CO2 levels fell within particular ranges.

Air quality metrics that are drawn from a variety of measurements can be used to generate several different types of graphical interfaces. For example, according to FIG. 9, the graphical interface may show an outlier chart of TVOC levels in a customer's building. The metrics collected can highlight multiple rooms with abnormal TVOC values, indicating potential filtration issues. In FIG. 10, the metrics are applied to display a series of operating schedule charts, where each chart includes occupancy estimates and CO2 data. These metrics can be used in determining periods of occupancy and consequently optimize the HVAC system's operating schedule. Similarly, the graphical interface in FIG. 11 is constructed using air quality metrics related to ventilation air changes, including estimated ventilation, the ASHRAE minimum ventilation, and demand-controlled ventilation changes. These metrics can help assess the effectiveness of ventilation in a room or zone.

Additionally, air quality metrics, as shown in FIGS. 12 and 13, are used to generate graphical interfaces that display CO2 levels and the ventilation-occupancy ratio within rooms. In FIG. 12, the interface shows how CO2 levels change over time in correlation with occupancy. This data is displayed on a scale similar to the ranges in FIG. 7. FIG. 13 uses air quality metrics to present ventilation-occupancy data points. The ventilation to occupancy (Voa) ratio metric helps determine if ventilation is sufficient for the number of people in a room, aiding in energy management and air quality control. In FIGS. 14, 15, and 16, air quality metrics are employed in different ways to monitor air quality and building performance. FIG. 14 shows how metrics can be used to recommend actions based on the current ventilation status of different spaces and potential savings from schedule changes or compliance with ASHRAE standards. FIG. 15 uses metrics to create a performance score table for different buildings or campuses across various parameters, allowing for easy comparisons across different locations. Lastly, FIG. 16 uses air quality metrics to create a geographical map with data points representing the air quality of specific locations. Users can interact with these points to get detailed air quality data, demonstrating the practical use of these metrics in air quality evaluation and management.

At block 1730, the one or more processing circuits can generate a graphical interface comprising a plurality of interface objects corresponding to the plurality of air quality metrics of the plurality of spaces of the building, wherein the plurality of interface objects correspond to at least one of an indoor air quality improvement or an energy savings opportunity. In general, the processing circuits can map the air quality metrics of different spaces within a building (or across building) onto corresponding interface objects. For instance, a space with high levels of CO2 could be represented by an interface object color-coded red, while a space with moderate levels could be green (i.e., various outlier data points or objects). Subsequently, additional details can be incorporated into the interface objects to offer more granular information. For example, hovering over an interface object (i.e., an interactable interface object) could reveal specific numerical metrics, like the precise concentration of PM2.5 or CO2, or the current temperature of a given space. Moreover, the interface objects could be animated to show temporal changes, effectively creating an animation of how air quality metrics change over time. Additionally, the generated graphical interface can also provide comparative data and indications of occupancy. An example of this could be a side-by-side comparison of air quality metrics from different spaces or floors within the building. This comparative display could highlight disparities in air quality across the building, which could in turn suggest uneven ventilation, different occupancy levels, or specific sources of air pollution. In some embodiments, the graphical interface can provide actionable insights based on the air quality metrics. For example, if a particular space consistently shows elevated PM2.5 levels, the interface could recommend increasing the filtration rate in that area, or if a space has consistently low CO2 levels, it might suggest reducing the ventilation rate to save energy. By making these recommendations easily accessible through the graphical interface, the system can facilitate prompt and informed decisions about building air quality management.

In some embodiments, the plurality of interface objects of the graphical interface include a detected occupied period based on the estimated occupancy of the at least one IAQ performance metric over the duration during the monitoring period, a current schedule based on the building system schedule of the at least one IAQ performance metric over the duration, a recommended schedule based on analyzing the plurality of air quality metrics over the duration and determining an improvement of the current schedule to increase air quality of the building, and raw air quality data based on the air quality measurements (additional details are described with reference to FIG. These elements combine to present an overview of air quality and HVAC operation. The detected occupied period and current schedule provide a benchmark against which the effectiveness of the existing HVAC operation can be gauged. The recommended schedule is the processing circuits output based on its analysis of these factors plus the raw air quality data. By comparing the current and recommended schedules, users can visualize the potential improvements in air quality and energy efficiency that could be achieved by implementing the recommended HVAC operating schedule.

In some embodiments, the graphical interface includes a plurality of graphical areas, and wherein at least one of the plurality of graphical areas includes a ventilation-occupancy data point, and wherein a first object of the plurality of interface objects is the ventilation-occupancy data point corresponding to a recommended ventilation action based on the estimated occupancy and at least one of the building system schedule or the building operating condition, and wherein the first object corresponds to a space of the plurality of spaces of the building (additional details are described with reference to FIG. 13). The graphical interface, in this way, brings together numerous variables into a single, unified display. Each ventilation-occupancy data point takes into account the distinctive features of its associated space. For instance, if a particular room is used heavily during morning hours but sits empty in the afternoon, the data point for that room would reflect the need for more intense ventilation in the morning to accommodate the higher occupancy. Conversely, if another room maintains a steady level of use throughout the day, its data point would show a more consistent need for ventilation. Furthermore, the ventilation-occupancy data point also incorporates a forward-looking component in the form of a recommended ventilation action. This recommendation comes from an analysis of patterns in the air quality metrics and the anticipated future use of the space. For example, if the metrics show that CO2 levels in a room typically rise in the late afternoon, and the room is regularly used for meetings at that time, the recommended action might call for increased ventilation in the afternoon to prevent CO2 buildup. Accordingly, the graphical interface and its ventilation-occupancy data points offer a view to translate raw data into meaningful information. With its ability to capture and display interactions between occupancy, ventilation, and building operations, the interface serves as a tool for managing a building's air quality.

In some embodiments, the graphical interface is a scatter plot graph, and wherein a first object of the plurality of interface objects is an outlier data point in the scatter plot graph, and wherein the first object corresponds to a space of the plurality of spaces of the building (additional details are described with reference to FIGS. 8-9). This outlier data point can be a specific representation of Indoor Air Quality (IAQ) values such as CO2, Total Volatile Organic Compounds (TVOCs), Particulate Matter 2.5 (PM2.5) levels, temperate and humidity levels, Volatile Organic Acids (VoA), and occupancy, obtained from sensors placed throughout the building. Each axis of the scatter plot graph includes data, e.g., the vertical axis depicting the standard deviation of an IAQ measurement and the horizontal axis depicting the average IAQ value. These outlier data points, diverging from the expected normal variation represented by circles on a graph, serve as flags for areas that may warrant additional investigation due to potential issues such as poor filtration or anomalous occupancy patterns. Contrarily, data points that fall within the expected circle (or range) indicate that the IAQ values are within the normal range, suggesting no immediate need for corrective actions.

In some embodiments, at least one of the plurality of interface objects corresponds to an indication of a range of air quality values of a plurality of ranges of air quality values, and wherein the plurality of ranges of air quality values include a low value, a low-medium value, a medium value, a medium-high value, and a high value. In some embodiments, the graphical interface is a graph including at least one plotted air quality variable, and wherein the at least one plotted air quality variable is overlayed on a plurality of graphics corresponding to at least one of the plurality of ranges of air quality values, and wherein the at least one plotted air quality variable includes an indication of occupation, and wherein the at least one plotted air quality variable is a first object of the plurality of interface objects and the plurality of graphics is a second object of the plurality of interface objects (additional details are described with reference to FIG. 12). Such graphic representation allows visual discernment of the room's air quality condition and occupancy pattern. This presentation integrates the occupancy with the plotted air quality values, which reveals the correlation between human presence and air quality shifts. In some embodiments, the graph overlaid on the plurality of graphics provides a visual benchmark against which the plotted air quality variable can be compared. By aligning these data plots with predefined ranges of air quality values, the processing circuits allows for an understanding of how the observed measurements relate to the expected standard norms. For example, a sharp rise in CO2 levels during occupancy may indicate an inadequate ventilation rate, which might call for a prompt adjustment in the ventilation system settings.

In some embodiments, the plurality of air quality metrics includes at least one building air quality metric of the building, and wherein the graphical interface is a chart comparing a plurality of building air quality metrics including the at least one building air quality metric across a plurality of buildings, and wherein the plurality of building air quality metrics corresponds to at least one of the plurality of ranges of air quality values (additional details are described with reference to FIG. 15). In particular, the interface plots building air quality metrics against a benchmark set by a group of buildings, displaying individual metrics in relation to comparable data from others. This visualization could surface patterns and trends, highlighting outliers or commonalities among the buildings' air quality metrics. The graphical interface could further translate these building air quality metrics into the predefined ranges of air quality values, low, low-medium, medium, medium-high, and high. Thus, it enables users to identify buildings that consistently fall into undesired air quality ranges, indicating potential need for intervention. By presenting a cross-building comparison in understandable categories, the interface aids in the process of air quality management across a portfolio of buildings.

In some embodiments, the plurality of air quality metrics includes at least one building air quality metric of the building, and wherein the graphical interface is a geographic map comparing a plurality of building air quality metrics including the at least one building air quality metric across a plurality of buildings, and wherein the plurality of building air quality metrics corresponds to at least one of the plurality of ranges of air quality values, and wherein a first geographic location of the building is a first object of the plurality of interface objects and a second geographic location of another building is a second object of the plurality of interface objects (additional details are described with reference to FIG. 16). This implementation provides a geographical visualization of the buildings, with each represented by a distinct object on the map. The interface objects correspond to the geographical locations of buildings, facilitating spatial comparison of air quality metrics across various sites. In some embodiments, each object on the map could display its corresponding building's air quality metrics, color-coded according to the air quality value range they fall into. This color-coding system could then be used to identify spatial patterns or discrepancies in air quality across the buildings. For example, buildings clustered in a particular area and consistently falling into the high air quality range may suggest regional influences on air quality. Conversely, in another example, significant variations in air quality metrics among nearby buildings could indicate the influence of building-specific factors, triggering a more detailed investigation into the respective buildings' operations.

In some embodiments, the graphical interface includes a first estimated savings plan for the plurality of spaces of the building based on a first building operating condition, and wherein the graphical interface includes a second estimated savings plan for the plurality of spaces of the building based on a second building operating condition, and wherein the first estimated savings plan is a first object of the plurality of interface objects and the second estimated savings plan is a second object of the plurality of interface objects additional details are described with reference to FIG. 14). This means that the interface objects can represent different savings plans, predicated on various building operating conditions. The first and second operating conditions could correspond to different building management strategies or scenarios. In some embodiments, the first object, representing the first estimated savings plan, could depict potential savings from implementing a specific strategy, such as retrofitting with energy-efficient HVAC systems or optimizing occupancy schedules to minimize energy consumption during peak hours. In contrast, the second object, representing the second estimated savings plan, might demonstrate possible savings from a different strategy, such as increasing insulation to improve thermal efficiency or introducing a building-wide air quality management program to reduce ventilation-related energy use. The simultaneous visualization allows for a direct comparison of the projected outcomes of different strategies.

In some embodiments, the graphical interface includes a series of interface objects that correspond to a range of air quality improvement strategies or energy savings opportunities, based on the plurality of air quality metrics. These interface objects serve as visual indicators of potential interventions that can optimize both the indoor air quality and energy performance of the building. For example, a specific interface object might signify an opportunity for enhanced ventilation in spaces with elevated CO2 levels. Another interface object could represent a potential energy saving measure, such as adjusting the HVAC schedule to match the occupancy patterns better, thereby reducing unnecessary energy consumption. Moreover, the interface objects could be color-coded or sized variably to visually rank the proposed strategies or improvement opportunities based on their potential impact or feasibility. Users can interact with these interface objects to retrieve more detailed information about each suggested intervention, such as the estimated cost, the expected improvement in air quality or energy efficiency, and the implementation timeline.

In certain embodiments, the air quality improvement strategies or energy savings opportunities may be reflected in a through the graphical interfaces. In some embodiments, the graphical interface may not depict numerical improvements or savings (sometimes it can, e.g., in FIG. 14), but also brings to light opportunities in the form of data visualization. For example, a color-coded range on a graph could highlight spaces within the building that are not meeting ideal air quality metrics. This visual signal indicates an opportunity for air quality improvement, prompting users to devise strategies to address the highlighted issues. Interface objects indicating occupancy can similarly represent energy saving opportunities. A correlation between high energy consumption and low occupancy could suggest potential for reducing energy usage during periods of low occupancy. Geographic location indicators among the interface objects could also illuminate areas for improvement or savings. A building positioned in a region with poor average air quality metrics may present a considerable opportunity for air quality improvement. The estimated savings plans represented as interface objects can convey potential paths to energy savings. These could be illustrated as alternative scenarios based on varying building operating conditions, encouraging users to consider different strategies for managing energy consumption in the building. By utilizing the informative nature of these graphical interfaces, the graphical interfaces present air quality improvement strategies and energy savings opportunities in a form that encourages understanding and facilitates strategic decision-making.

At block 1740, the one or more processing circuits can cause a display device of a user device to display the graphical interface. This block includes transmitting or providing the data from the processing circuits to the user device, which may be a controller, a personal computer, a mobile device, or any other suitable device equipped with a display. The display of the user device then visually renders the graphical interface, allowing the user to interact with the interface objects, analyze air quality metrics, compare estimated savings plans for different building operating conditions, and consequently make decisions about building management strategies. The user device may also be equipped with input means, such as a keyboard or touchscreen, to enable user commands for adjusting or manipulating the displayed interface.

In some embodiments, the processing circuits can generate a control strategy. This control strategy is generated based on both (or one) the plurality of air quality metrics and a viral index. In particular, the control strategy can be used to manipulate the equipment within the building in such a manner as to reduce the spread of an infectious disease among the occupants of the building. Following the generation of the control strategy, the processing circuits then cause the building management system to implement this strategy. The building management system, in response, adjusts the control of the equipment within the building in accordance with the devised strategy. The adjustments may involve modifications to HVAC systems, air purification units, ventilation settings, or any other equipment that can influence the indoor air quality.

In some embodiments, the processing circuits are programmed to generate a control strategy based on an analysis of the plurality of air quality metrics and a viral index. These metrics may include parameters such as temperature, humidity, CO2 levels, PM2.5 levels, and volatile organic compounds (VOCs), amongst others. The viral index can be a quantified measure of the risk of viral transmission within the building, which might be determined based on factors such as the known presence of infectious individuals, the viral load in the air, community/governmental data, and/or the susceptibility of the building's occupants. For example, when the viral index is high, the control strategy might be implemented by the HVAC system to increase the rate of ventilation. This increase in ventilation would dilute any potential viral particles present in the indoor air, reducing the risk of inhalation by the building's occupants. Simultaneously, the HVAC system could be instructed to maintain a slightly higher indoor temperature and a relative humidity level around 40-60%. In another example, the control strategy may include the operation of air purification units. These areas could be determined from occupancy data or other risk indicators, such as rooms with poor natural ventilation or spaces that are frequently used by individuals who are at higher risk of severe disease. The air purification units, equipped with High-Efficiency Particulate Air (HEPA) filters or ultraviolet germicidal irradiation (UVGI), can remove, or inactivate airborne pathogens, enhancing the safety of these critical areas. Once the control strategy is formulated, the processing circuits then command the building management system to put this plan into action. The building management system, interfacing with various building equipment and systems, adjusts their operation as per the control strategy.

The construction and arrangement of the systems and methods as shown in the various exemplary embodiments are illustrative only. Although only a few embodiments have been described in detail in this disclosure, many modifications are possible (e.g., variations in sizes, dimensions, structures, shapes and proportions of the various elements, values of parameters, mounting arrangements, use of materials, colors, orientations, etc.). For example, the position of elements can be reversed or otherwise varied and the nature or number of discrete elements or positions can be altered or varied. Accordingly, all such modifications are intended to be included within the scope of the present disclosure. The order or sequence of any process or method steps can be varied or re-sequenced according to alternative embodiments. Other substitutions, modifications, changes, and omissions can be made in the design, operating conditions, and arrangement of the exemplary embodiments without departing from the scope of the present disclosure.

The present disclosure contemplates methods, systems, and program products on any machine-readable media for accomplishing various operations. The embodiments of the present disclosure can be implemented using existing computer processors, or by a special purpose computer processor for an appropriate system, incorporated for this or another purpose, or by a hardwired system. Embodiments within the scope of the present disclosure include program products including machine-readable media for carrying or having machine-executable instructions or data structures stored thereon. Such machine-readable media can be any available media that can be accessed by a general purpose or special purpose computer or other machine with a processor. By way of example, such machine-readable media can include RAM, ROM, EPROM, EEPROM, CD-ROM or other optical disk storage, magnetic disk storage or other magnetic storage devices, or any other medium which can be used to carry or store desired program code in the form of machine-executable instructions or data structures and which can be accessed by a general purpose or special purpose computer or other machine with a processor. Combinations of the above are also included within the scope of machine-readable media. Machine-executable instructions include, for example, instructions and data which cause a general purpose computer, special purpose computer, or special purpose processing machines to perform a certain function or group of functions.

Although the figures show a specific order of method steps, the order of the steps may differ from what is depicted. Also, two or more steps can be performed concurrently or with partial concurrence. Such variation will depend on the software and hardware systems chosen and on designer choice. All such variations are within the scope of the disclosure. Likewise, software implementations could be accomplished with standard programming techniques with rule based logic and other logic to accomplish the various connection steps, processing steps, comparison steps and decision steps.

What is claimed is:

1. A building analytical system for a building, the building analytical system comprising one or more memory devices storing instructions thereon that, when executed by one or more processors, cause the one or more processors to:

receive air quality measurements of at least a plurality of air quality sensors of a plurality of spaces of the building over a duration during a monitoring period;

generate a plurality of air quality metrics of the plurality of spaces based on the air quality measurements and at least one indoor air quality (IAQ) performance metric, wherein the at least one IAQ performance metric contextualizes the air quality measurements of the building over the duration during the monitoring period, and wherein the plurality of air quality metrics correspond to a plurality of ranges of air quality values, and wherein the plurality of ranges of air quality values comprise at least a low value, a medium value, and a high value;

generate a graphical interface comprising a plurality of interface objects corresponding to the plurality of air quality metrics of the plurality of spaces of the building, wherein the plurality of interface objects correspond to at least one of an indoor air quality improvement or an energy savings opportunity; and cause a display device of a user device to display the graphical interface.

2. The building analytical system of claim 1, wherein the generation of the plurality of air quality metrics comprises comparing the air quality measurements with the at least one IAQ performance metric, and wherein the at least one IAQ performance metric comprises at least one of an estimated occupancy, a building system schedule, a building operating condition, or temporal representations of levels of air quality.

3. The building analytical system of claim 2, wherein the plurality of interface objects of the graphical interface comprise:

a detected occupied period based on an indication of occupancy or the estimated occupancy of the at least one IAQ performance metric over the duration;

a current schedule based on the building system schedule of the at least one IAQ performance metric over the duration;

a recommended schedule based on analyzing the plurality of air quality metrics over the duration and determining an improvement of the current schedule to increase air quality of the building; and raw air quality data based on the air quality measurements.

4. The building analytical system of claim 2, wherein the graphical interface comprises a plurality of graphical areas, and wherein at least one of the plurality of graphical areas comprises a ventilation-occupancy data point, and wherein a first object of the plurality of interface objects is the ventilation-occupancy data point corresponding to a recommended ventilation action based on the estimated occupancy and at least one of the building system schedule or the building operating condition, and wherein the first object corresponds to a space of the plurality of spaces of the building.

5. The building analytical system of claim 1, wherein the graphical interface is a scatter plot graph, and wherein a first object of the plurality of interface objects is an outlier data point in the scatter plot graph, and wherein the first object corresponds to a space of the plurality of spaces of the building.

6. The building analytical system of claim 1, wherein at least one of the plurality of interface objects corresponds to an indication of a range of air quality values of the plurality of ranges of air quality values, and wherein the plurality of ranges of air quality values comprise the low value, a low-medium value, the medium value, a medium-high value, and the high value.

7. The building analytical system of claim 6, wherein the graphical interface is a graph comprising at least one plotted air quality variable, and wherein the at least one plotted air quality variable is overlayed on a plurality of graphics corresponding to at least one of the plurality of ranges of air quality values, and wherein the at least one plotted air quality variable comprises an indication of occupation, and wherein the at least one plotted air quality variable is a first object of the plurality of interface objects and the plurality of graphics is a second object of the plurality of interface objects.

8. The building analytical system of claim 6, wherein the plurality of air quality metrics comprises at least one building air quality metric of the building, and wherein the graphical interface is a chart comparing a plurality of building air quality metrics including the at least one building air quality metric across a plurality of buildings, and wherein the plurality of building air quality metrics corresponds to at least one of the plurality of ranges of air quality values.

9. The building analytical system of claim 6, wherein the plurality of air quality metrics comprises at least one building air quality metric of the building, and wherein the graphical interface is a geographic map comparing a plurality of building air quality metrics including the at least one building air quality metric across a plurality of buildings, and wherein the plurality of building air quality metrics corresponds to at least one of the plurality of ranges of air quality values, and wherein a first geographic location of the building is a first object of the plurality of interface objects and a second geographic location of another building is a second object of the plurality of interface objects.

10. The building analytical system of claim 1, wherein the graphical interface comprises a first estimated savings plan for the plurality of spaces of the building based on a first building operating condition, and wherein the graphical interface comprises a second estimated savings plan for the plurality of spaces of the building based on a second building operating condition, and wherein the first estimated savings plan is a first object of the plurality of interface objects and the second estimated savings plan is a second object of the plurality of interface objects.

11. The building analytical system of claim 1, wherein the air quality measurements are at least one of total volatile organic compounds (TVOC), carbon dioxide (CO2), carbon monoxide (CO), nitrogen dioxide (NO2), sulfur dioxide (SO2), ozone, particulate matters, formaldehyde, fungi, lead (Pb), bacteria, protist, virus, or pathogen.

12. The building analytical system of claim 1, wherein the instructions cause the one or more processors to:

receive indoor air quality measurements of the plurality of air quality sensors of the plurality of spaces of the building; and receive outdoor air quality measurements of outdoor air quality outside the building;

wherein the generation of the plurality of air quality metrics of the plurality of spaces further comprises comparing the indoor air quality measurements to the outdoor air quality measurements, and wherein the plurality of air quality metrics are a ratio of the indoor air quality measurements to the outdoor air quality measurements.

13. The building analytical system of claim 1, wherein the plurality of air quality sensors are a plurality of temporary air quality sensors installed throughout the plurality of spaces of the building for a period of time;

wherein the instructions cause the one or more processors to:

connect to the plurality of temporary air quality sensors installed throughout the plurality of spaces of the building for the period of time; and disconnect from the plurality of temporary air quality sensors at an end of the period of time, wherein the plurality of temporary air quality sensors are uninstalled at the end of the period of time.

14. The building analytical system of claim 13, wherein the building analytical system is a cloud system located remotely from the building, and wherein the cloud system is configured to receive the air quality measurements via one or more wireless networks of the building, and wherein the plurality of temporary air quality sensors are configured to wirelessly communicate via the one or more wireless networks.

15. The building analytical system of claim 1, wherein the instructions cause the one or more processors to:

generate a control strategy, based on the plurality of air quality metrics and a viral index, the control strategy for controlling equipment of the building to reduce a spread of an infectious disease among occupants of the building; and cause a building management system to implement the control strategy to control the equipment of the building to reduce the spread of the infectious disease among the occupants of the building.

16. A method, comprising:

receiving, by one or more processing circuits, air quality measurements of at least a plurality of air quality sensors of a plurality of spaces of a building over a duration during a monitoring period;

generating, by the one or more processing circuits, a plurality of air quality metrics of the plurality of spaces based on the air quality measurements and at least one indoor air quality (IAQ) performance metric, wherein the at least one IAQ performance metric contextualizes the air quality measurements of the building over the duration during the monitoring period, and wherein the plurality of air quality metrics correspond to a plurality of ranges of air quality;

generating, by the one or more processing circuits, a graphical interface comprising a plurality of interface objects corresponding to the plurality of air quality metrics of the plurality of spaces of the building, wherein the plurality of interface objects correspond to at least one of an indoor air quality improvement or an energy savings opportunity, and wherein the plurality of ranges of air quality values comprise at least a low value, a medium value, and a high value; and causing, by the one or more processing circuits, a display device of a user device to display the graphical interface.

17. The method of claim 16, wherein the generation of the plurality of air quality metrics comprises comparing the air quality measurements with the at least one IAQ performance metric, and wherein the at least one IAQ performance metric comprises at least one of an estimated occupancy, a building system schedule, a building operating condition, or temporal representations of levels of air quality.

18. The method of claim 16, wherein at least one of the plurality of interface objects corresponds to an indication of a range of air quality values of the plurality of ranges of air quality values, and wherein the plurality of ranges of air quality values comprise the low value, a low-medium value, the medium value, a medium-high value, and the high value.

19. One or more non-transitory computer readable mediums storing instructions thereon that, when executed by one or more processors, cause the one or more processors to:

receive air quality measurements of at least a plurality of air quality sensors of a plurality of spaces of a building over a duration during a monitoring period;

generate a plurality of air quality metrics of the plurality of spaces based on the air quality measurements and at least one indoor air quality (IAQ) performance metric, wherein the at least one IAQ performance metric contextualizes the air quality measurements of the building over the duration during the monitoring period, and wherein the plurality of air quality metrics correspond to a plurality of ranges of air quality;

generate a graphical interface comprising a plurality of interface objects corresponding to the plurality of air quality metrics of the plurality of spaces of the building, wherein the plurality of interface objects correspond to at least one of an indoor air quality improvement or an energy savings opportunity, and wherein the at least one IAQ performance metric comprises at least one of an estimated occupancy, a building system schedule, or temporal representations of levels of air quality; and cause a display device of a user device to display the graphical interface.

20. The one or more non-transitory computer readable mediums of claim 19, wherein the generation of the plurality of air quality metrics comprises comparing the air quality measurements with the at least one IAQ performance metric, and wherein at least one of the plurality of interface objects corresponds to an indication of a range of air quality values of the plurality of ranges of air quality values, and wherein the plurality of ranges of air quality values comprise a low value, a low-medium value, a medium value, a medium-high value, and a high value.

* * * * *